US009602944B2

(12) United States Patent
Steffens

(10) Patent No.: US 9,602,944 B2
(45) **Date of Patent: *Mar. 21, 2017**

(54) APPARATUS AND METHOD FOR CREATING PROXIMITY SOUND EFFECTS IN AUDIO SYSTEMS

(71) Applicant: BARCO NV, Kortrijk (BE)

(72) Inventor: Robert Steffens, Niedermissa (DE)

(73) Assignee: Barco NV, Kortrijk (BE)

( * ) Notice: Subject to any disclaimer, the term of this patent is extended or adjusted under 35 U.S.C. 154(b) by 135 days.

This patent is subject to a terminal disclaimer.

(21) Appl. No.: 14/503,093

(22) Filed: Sep. 30, 2014

(65) Prior Publication Data

US 2015/0016643 A1 Jan. 15, 2015

Related U.S. Application Data

(63) Continuation of application No. PCT/EP2013/056689, filed on Mar. 28, 2013.
(Continued)

(51) Int. Cl.
*H04S 3/00* (2006.01)
*H04S 5/02* (2006.01)
*H04S 7/00* (2006.01)

(52) U.S. Cl.
CPC ..... *H04S 5/02* (2013.01); *H04S 3/00* (2013.01); *H04S 7/30* (2013.01); *H04S 7/302* (2013.01);
(Continued)

(58) Field of Classification Search
CPC ..... H04S 7/30; H04S 5/02; H04S 3/00; H04S 7/302; H04S 7/303; H04S 2420/13; H04R 2499/13
(Continued)

(56) References Cited

U.S. PATENT DOCUMENTS 7,649,444 B1 1/2010 Fear et al.
7,684,578 B2 3/2010 Roeder et al.
(Continued)

FOREIGN PATENT DOCUMENTS

CN 1605226 4/2005
CN 101658052 2/2010
(Continued)

OTHER PUBLICATIONS

Ahrens, J. et al., "Focusing of virtual sound sources in higher order Ambisonics," AES 124th Convention, Amsterdam, The Netherlands, May 17-20, 2008, pp. 1-9.
(Continued)

*Primary Examiner* — Melur Ramakrishnaiah
(74) *Attorney, Agent, or Firm* — Renner, Otto, Boisselle & Sklar, LLP

(57) ABSTRACT

An apparatus for driving loudspeakers of a sound system is provided. The sound system has at least two loudspeakers of a basic system and at least three loudspeakers of a focus system, each of the loudspeakers having a position in an environment. The apparatus has a basic channel provider for providing basic system audio channels to drive the loudspeakers of the basic system, and a focused source renderer for providing focus system audio channels to drive the loudspeakers of the focus system. The focused source renderer is configured to calculate a plurality of delay values for the loudspeakers of the focus system based on the positions of the loudspeakers of the focus system and based on a position of a focus point, and to generate at least three focus group audio channels for at least some of the loudspeakers of the focus system based on the plurality of delay values and based on a focus audio base signal to provide the focus system audio channels.

21 Claims, 20 Drawing Sheets

Related U.S. Application Data

(60) Provisional application No. 61/618,214, filed on Mar. 30, 2012.

(52) U.S. Cl.
CPC ..... *H04R 2499/13* (2013.01); *H04S 7/303* (2013.01); *H04S 2420/13* (2013.01)

(58) Field of Classification Search
USPC ..... 381/307–310, 17–20, 22, 313
See application file for complete search history.

(56) References Cited

U.S. PATENT DOCUMENTS

| | | | | |
|---|---|---|---|---|
| 2006/0050897 | A1* | 3/2006 | Asada | H04R 3/12 381/98 |
| 2007/0189549 | A1* | 8/2007 | Scheel | H04R 27/00 381/86 |
| 2007/0269062 | A1 | 11/2007 | Rodigast et al. | |
| 2009/0087000 | A1* | 4/2009 | Ko | H04R 1/403 381/182 |
| 2009/0136048 | A1* | 5/2009 | Yoo | H04S 3/008 381/27 |
| 2011/0081024 | A1 | 4/2011 | Soulodre | |
| 2011/0216906 | A1* | 9/2011 | Swaminathan | H04R 5/00 381/17 |
| 2012/0230497 | A1 | 9/2012 | Dressler et al. | |
| 2013/0261887 | A1* | 10/2013 | Raz | B60Q 5/00 701/36 |

FOREIGN PATENT DOCUMENTS

| | | | |
|---|---|---|---|
| EP | 1637012 | B1 | 1/2007 |
| EP | 1800517 | A1 | 6/2007 |
| WO | 02/071796 | A1 | 9/2002 |
| WO | 2004/114725 | A1 | 12/2004 |
| WO | 2006/058602 | A1 | 6/2006 |
| WO | 2009/124772 | A1 | 10/2009 |
| WO | 2011/020065 | A1 | 2/2011 |

OTHER PUBLICATIONS

Berkhout, A. J. et al., "Acoustic Control by Wave Field Synthesis," Journal Acoustic Society of America (1993); vol. 93, No. 5, May 1993, pp. 2764-2778.

Brix, S. et al., "Wave Field Synthesis Based Concept Car for High-Quality Automotive Sound", AES 48th International Conference, Munich, Germany, Sep. 21-23, 2012, pp. 1-10.

Engdegård, J. et al., "Spatial Audio Object Coding (SAOC)—The Upcoming MPEG Standard on Parametric Object Based Audio Coding." Audio Engineering Society, 124th Convention, May 17-20, 2008, Amsterdam, The Netherlands, pp. 1-15.

Strauss, M. et al., "Application of Wave Field Synthesis and Analysis on Automotive Audio", Audio Engineering Society, AES Convention 131, New York, NY, Oct. 20-23, 2011, pp. 1-4.

Yon, S. et al., "Sound focusing in rooms: The time-reversal approach", J. Acoust. Soc. Am., vol. 113, No. 3, Mar. 2003, pp. 1533-1543.

Translation of CN Office Action dated May 30, 2016, for corresponding CN Patent Application No. 2013800286322.

* cited by examiner

APPARATUS AND METHOD FOR CREATING PROXIMITY SOUND EFFECTS IN AUDIO SYSTEMS

CROSS-REFERENCE TO RELATED APPLICATIONS

This application is a continuation of copending International Application No. PCT/EP2013/056689, filed Mar. 28, 2013, which is incorporated herein by reference in its entirety, and additionally claims priority from U.S. Provisional Application No. 61/618,214, filed Mar. 30, 2012, which is also incorporated herein by reference in its entirety.

BACKGROUND OF THE INVENTION

The present invention relates to the creation of proximity sound effects and, in particular, to an apparatus and method for creating proximity sound effects in audio systems.

The present application is related to the state of the art in channel-based surround sound audio reproduction and object-based scene rendering. There exist several surround sound systems that reproduce audio with a plurality of loudspeakers placed around a so called sweet spot. A sweet spot is the place where the listener should be positioned to perceive an optimal spatial impression of the audio content. Most popular systems that work like that are regular 5.1 or 7.1 systems with 5 or 7 loudspeakers positioned on a circle or sphere around the listener and a low frequency effect channel. The audio signals to feed the loudspeakers are either created during the production process by a mixer (e.g. motion picture sound track) or are generated in real-time, e.g. in interactive gaming scenarios.

State-of-the-art surround sound systems can produce sounds placed nearly in any direction with respect of a listener positioned in the sweet spot of a system. What is not possible to reproduce with existing 5.1 or 7.1 surround sound are auditory events that the listener perceives in a close distance to his head. Several other spatial audio technologies like Wave Field Synthesis (WFS) or Higher Order Ambisonic (HOA) systems are able to produce so called focused sources, which can create that proximity effect using a high number of loudspeakers to concentrate acoustic energy at a steerable position relative to the speakers.

In particular, in the state of the art, several algorithms are used to place auditory events around the listener. Wave Field Synthesis systems using a much larger number of loudspeakers than regular surround sound systems are able to position auditory events outside and even inside the room [1, 2]. The sources which are positioned inside the room are usually called "focused sources" because they are calculated to focus sound energy at a specific spot located within the loudspeaker array. Typical WFS systems comprise an array of loudspeakers around the listener. However, the amount of loudspeakers needed usually is very high leading to the use of expensive loudspeaker panels with small loudspeaker drivers.

Another approach to reproduce focused sources that have similar characteristics as using WFS focus sources is Higher Order Ambisonics (HOA) [3].

In [4], a device is described utilizing a plurality of loudspeakers for steering sound to a specific point in space by using individually calculated delays for all loudspeakers. There also exists an approach called "time reversal mirror" [5] to optimize the effect of focused source by increasing the difference in sound level between the focus point and its surrounding area.

In the known art, a WFS system is combined with regular, but larger and more powerful speakers to be able to combine the high resolution of sound localization that WFS provides with the powerful sound levels that typical live public address (PA) systems can provide. In [6], a combination of a WFS system with additional large single loudspeakers is described where the additional loudspeakers are meant to support the WFS system in terms of sound level. The delay between those two systems is set so that the sound of the WFS speakers arrives at the listener position before the sound of the additional loudspeakers. This is done in order to use the precedence effect; the listeners will localize the source according to the sound of the WFS system with the higher localization resolution while the additional loudspeakers will help increase the perceived loudness without significantly affecting the localization perception of the sound source.

While using a full WFS system at home is not feasible due to the high number of individual loudspeakers needed, sound bars containing a multitude of speakers are already available and can be used to play back focused sources.

However, while WFS can reproduce several types of audio objects (e.g. point sources and plane waves [1]), the high resolution of localization for sources farer away is usually not required at home.

It would be appreciated, if improved concepts for creating proximity sound effects would be provided.

SUMMARY

According to an embodiment, an apparatus for driving loudspeakers of a sound system, the sound system comprising at least two loudspeakers of a basic system, and at least three loudspeakers of a focus system, wherein each of the loudspeakers of the basic system and of the focus system has a position in an environment, may have: a basic channel provider for providing basic system audio channels to drive the loudspeakers of the basic system, a focused source renderer for providing focus system audio channels to drive the loudspeakers of the focus system, wherein the focused source renderer is configured to calculate a plurality of delay values for the loudspeakers of the focus system based on the positions of the loudspeakers of the focus system and based on a position of a focus point, wherein the focused source renderer is configured to generate at least three focus group audio channels for at least some of the loudspeakers of the focus system based on the plurality of delay values and based on a focus audio base signal to provide the focus system audio channels.

According to another embodiment, a system may have: an apparatus as mentioned above, and at least one tracking unit, wherein the above apparatus is configured to receive a position of a listener from the at least one tracking unit, and wherein the above apparatus is adapted to shift the focus point depending on the position of the listener.

According to another embodiment, an encoding module for encoding a surround audio base signal, a focus audio base signal and a position of a focus point may have: a downmix module for generating a focus downmix, comprising a plurality of channels, based on the focus audio base signal and the position of the focus point, such that the focus downmix has the same number of channels as the surround audio base signal, a mixer for mixing the surround audio base signal and the focus downmix to obtain a surround audio mix signal, and a bitstream encoding unit for encoding the surround audio mix signal, the focus audio base signal and the position of the focus point as a data stream.

According to another embodiment, a system may have: an encoding module as mentioned above, and an apparatus as mentioned above, wherein the basic audio mix signal is a surround audio mix signal, wherein the basic audio base signal is a surround audio base signal, wherein the subtractor is configured to subtract the focus downmix from the surround audio mix signal to obtain the surround audio base signal, and wherein the subtractor is configured to feed the surround audio base signal into the basic channel provider being a surround channel provider, wherein the above encoding unit is configured to transmit a surround audio mix signal, a focus audio base signal and a position of a focus point as a data stream to the above apparatus, wherein the bitstream decoding unit of the above apparatus is configured to decode the data stream to obtain the surround audio mix signal, the focus audio base signal and the position of the focus point, wherein the decoder of the above apparatus is configured to feed the focus audio base signal and the position of the focus point into the focused source renderer of the above apparatus, wherein the downmix module of the above apparatus is configured to generate a focus downmix from the focus audio base signal and from the position of the focus point, wherein the subtractor of the above apparatus is configured to subtract the focus downmix from the surround audio mix signal to obtain a surround audio base signal, and wherein the subtractor of the above apparatus is configured to feed the surround audio base signal into the basic channel provider of the above apparatus, being a surround channel provider.

According to another embodiment, a sound system may have: a basic system comprising at least two loudspeakers, a focus system comprising at least three further loudspeakers, a first amplifier module, a second amplifier module, and an apparatus as mentioned above, wherein the first amplifier module is arranged to receive the basic system audio channels provided by the basic channel provider of the above apparatus, and wherein the first amplifier module is configured to drive the loudspeakers of the basic system based on the basic system audio channels, and wherein the second amplifier module is arranged to receive the focus system audio channels provided by the focused source renderer of the above apparatus, and wherein the second amplifier module is configured to drive the loudspeakers of the focus system based on the focus system audio channels.

According to another embodiment, a method for driving loudspeakers of a sound system, the sound system comprising at least two loudspeakers of a basic system, and at least three loudspeakers of a focus system, wherein each of the loudspeakers of the basic system and of the focus system has a position in an environment, may have the steps of: providing basic system audio channels to drive the loudspeakers of the basic system, providing focus system audio channels to drive the loudspeakers of the focus system, calculating a plurality of delay values for the loudspeakers of the focus system based on the positions of the loudspeakers of the focus system and based on a position of a focus point, and generating at least three focus group audio channels for at least some of the loudspeakers of the focus system based on the plurality of delay values and based on a focus audio base signal to provide the focus system audio channels.

According to another embodiment, an apparatus for driving loudspeakers of a sound system, the sound system comprising at least two loudspeakers of a basic system, and at least three loudspeakers of a focus system, wherein each of the loudspeakers of the basic system and of the focus system has a position in an environment, may have: a basic channel provider for providing basic system audio channels to drive the loudspeakers of the basic system, a focused source renderer for providing focus system audio channels to drive the loudspeakers of the focus system, wherein the focused source renderer is configured to calculate a plurality of delay values for the loudspeakers of the focus system based on the positions of the loudspeakers of the focus system and based on a position of a focus point, wherein the focused source renderer is configured to generate at least three focus group audio channels for at least some of the loudspeakers of the focus system based on the plurality of delay values and based on a focus audio base signal to provide the focus system audio channels, wherein the basic channel provider is configured to generate the basic system audio channels based on the focus audio base signal and based on panning information for blending the focus audio base signal between the basic system and the focus system, and wherein the focused source renderer is configured to generate the at least three focus group audio channels based on the focus audio base signal and based on the panning information for blending the focus audio base signal between the basic system and the focus system.

According to another embodiment, an apparatus for driving loudspeakers of a sound system, the sound system comprising at least two loudspeakers of a basic system, and at least three loudspeakers of a focus system, wherein each of the loudspeakers of the basic system and of the focus system has a position in an environment, may have: a basic channel provider for providing basic system audio channels to drive the loudspeakers of the basic system, a focused source renderer for providing focus system audio channels to drive the loudspeakers of the focus system, wherein the focused source renderer is configured to calculate a plurality of delay values for the loudspeakers of the focus system based on the positions of the loudspeakers of the focus system and based on a position of a focus point, wherein the focused source renderer is configured to generate at least three focus group audio channels for at least some of the loudspeakers of the focus system based on the plurality of delay values and based on a focus audio base signal to provide the focus system audio channels, wherein the focus audio base signal only comprises first frequency portions of an audio effect signal, wherein the first frequency portions only have frequencies which are higher than a first predetermined frequency value, and wherein at least some of the first frequency portions have frequencies which are higher than a second predetermined frequency value, wherein the second predetermined frequency value is higher than or equal to the first predetermined frequency value, and wherein the focused source renderer is configured to generate the at least three focus group audio channels based on the focus audio base signal such that the focus group audio channels only have frequencies which are higher than the first predetermined frequency value.

According to still another embodiment, an apparatus for driving loudspeakers of a sound system, the sound system comprising at least two loudspeakers of a basic system, and at least three loudspeakers of a focus system, wherein each of the loudspeakers of the basic system and of the focus system has a position in an environment, may have: a basic channel provider for providing basic system audio channels to drive the loudspeakers of the basic system, a focused source renderer for providing focus system audio channels to drive the loudspeakers of the focus system, wherein the focused source renderer is configured to calculate a plurality of delay values for the loudspeakers of the focus system based on the positions of the loudspeakers of the focus system and based on a position of a focus point, wherein the focused source renderer is configured to generate at least three focus group audio channels for at least some of the loudspeakers of the focus system based on the plurality of delay values and based on a focus audio base signal to provide the focus system audio channels, wherein the apparatus furthermore comprises a filter unit and a panner, wherein the filter unit is configured to receive an audio effect signal, wherein the filter unit is configured to filter the audio effect signal to obtain a secondary effect signal and the focus audio base signal, such that the focus audio base signal is different from the audio effect signal, wherein the panner is configured to generate a first panned focus base signal and a second panned focus base signal by modifying the focus audio base signal depending on panning information, wherein the focused source renderer is configured to provide the focus system audio channels based on the first panned focus base signal, and wherein the basic channel provider is configured to provide the basic system audio channels based on the secondary effect signal and based on the second panned focus base signal.

According to another embodiment, an apparatus for driving loudspeakers of a sound system, the sound system comprising at least two loudspeakers of a basic system, and at least three loudspeakers of a focus system, wherein each of the loudspeakers of the basic system and of the focus system has a position in an environment, may have: a basic channel provider for providing basic system audio channels to drive the loudspeakers of the basic system, a focused source renderer for providing focus system audio channels to drive the loudspeakers of the focus system, wherein the focused source renderer is configured to calculate a plurality of delay values for the loudspeakers of the focus system based on the positions of the loudspeakers of the focus system and based on a position of a focus point, wherein the focused source renderer is configured to generate at least three focus group audio channels for at least some of the loudspeakers of the focus system based on the plurality of delay values and based on a focus audio base signal to provide the focus system audio channels, wherein the apparatus furthermore comprises a decoder, wherein the decoder comprises a bitstream decoding unit and a filter, wherein the filter comprises a downmix module and a subtractor, wherein the bitstream decoding unit is configured to decode a data stream to obtain a basic audio mix signal, the focus audio base signal and the position of the focus point, wherein the decoder is configured to feed the focus audio base signal and the position of the focus point into the focused source renderer, wherein the downmix module is configured to generate a focus downmix from the focus audio base signal and from the position of the focus point, wherein the subtractor is configured to subtract the focus downmix from the basic audio mix signal to obtain a basic audio base signal, and wherein the subtractor is configured to feed the basic audio base signal into the basic channel provider.

According to another embodiment, an apparatus for driving loudspeakers of a sound system, the sound system comprising at least two loudspeakers of a basic system, and at least three loudspeakers of a focus system, wherein each of the loudspeakers of the basic system and of the focus system has a position in an environment, may have: a basic channel provider for providing basic system audio channels to drive the loudspeakers of the basic system, a focused source renderer for providing focus system audio channels to drive the loudspeakers of the focus system, wherein the focused source renderer is configured to calculate a plurality of delay values for the loudspeakers of the focus system based on the positions of the loudspeakers of the focus system and based on a position of a focus point, wherein the focused source renderer is configured to generate at least three focus group audio channels for at least some of the loudspeakers of the focus system based on the plurality of delay values and based on a focus audio base signal to provide the focus system audio channels, wherein the apparatus furthermore comprises a decoder being configured to decode a data stream to obtain a first group of one or more audio input channels, a second group of one or more audio input channels and meta-data comprising information on the position of the focus point, wherein the information on the position of the focus point is relative to a position of a listener, wherein the decoder is arranged to feed the first group of audio input channels into the basic channel provider, and wherein the basic channel provider is configured to provide the basic system audio channels to the loudspeakers of the basic system based on the first group of audio input channels, and wherein the decoder is arranged to feed the second group of audio input channels and the information on the position of the focus point into the focused source renderer, and wherein the focused source renderer is configured to generate the at least three focus group audio channels based on the focus audio base signal, wherein the focus audio base signal depends on one or more audio input channels of the second group of audio input channels, wherein the decoder is configured to decode the data stream to obtain six channels of an HDMI audio signal as the first group of audio input channels, and wherein the decoder is configured to decode the data stream to obtain two further channels of the HDMI audio signal as the second group of audio input channels.

According to another embodiment, an apparatus for driving loudspeakers of a sound system, the sound system comprising at least two loudspeakers of a basic system, and at least three loudspeakers of a focus system, wherein each of the loudspeakers of the basic system and of the focus system has a position in an environment, may have: a basic channel provider for providing basic system audio channels to drive the loudspeakers of the basic system, a focused source renderer for providing focus system audio channels to drive the loudspeakers of the focus system, wherein the focused source renderer is configured to calculate a plurality of delay values for the loudspeakers of the focus system based on the positions of the loudspeakers of the focus system and based on a position of a focus point, wherein the focused source renderer is configured to generate at least three focus group audio channels for at least some of the loudspeakers of the focus system based on the plurality of delay values and based on a focus audio base signal to provide the focus system audio channels, wherein the apparatus furthermore comprises a decoder being configured to decode a data stream to obtain a first group of one or more audio input channels, a second group of one or more audio input channels and meta-data comprising information on the position of the focus point, wherein the information on the position of the focus point is relative to a position of a listener, wherein each of the audio input channels of the first group of audio input channels comprises basic channel information and first focus information, wherein each of the audio input channels of the second group of audio input channels comprises second focus information, wherein the decoder is configured to generate a third group of one or more modified audio channels based on the basic channel information of the first group of the audio input channels, wherein the decoder is arranged to feed the third group of modified audio channels into the basic channel provider, and wherein the basic channel provider is configured to provide the basic system audio channels to the loudspeakers of the basic system based on the third group of modified audio channels, wherein the decoder is configured to generate a fourth group of modified audio channels based on the first focus information of the first group of audio input channels and based on the second focus information of the second group of audio input channels, wherein the decoder is arranged to feed the fourth group of modified audio channels and the information on the position of the focus point into the focused source renderer, and wherein the focused source renderer is configured to generate the at least three focus group audio channels based on the focus audio base signal, wherein the focus audio base signal depends on one or more modified audio channels of the fourth group of modified audio channels, and wherein the decoder is configured to decode the data stream to obtain six channels of an HDMI audio signal as the first group of audio input channels, and wherein the decoder is configured to decode the data stream to obtain two further channels of the HDMI audio signal as the second group of audio input channels.

According to another embodiment, an apparatus for driving loudspeakers of a sound system, the sound system comprising at least two loudspeakers of a basic system, and at least three loudspeakers of a focus system, wherein each of the loudspeakers of the basic system and of the focus system has a position in an environment, may have: a basic channel provider for providing basic system audio channels to drive the loudspeakers of the basic system, a focused source renderer for providing focus system audio channels to drive the loudspeakers of the focus system, wherein the focused source renderer is configured to calculate a plurality of delay values for the loudspeakers of the focus system based on the positions of the loudspeakers of the focus system and based on a position of a focus point, wherein the focused source renderer is configured to generate at least three focus group audio channels for at least some of the loudspeakers of the focus system based on the plurality of delay values and based on a focus audio base signal to provide the focus system audio channels, wherein the apparatus furthermore comprises a decoder being configured to decode a data stream to obtain a first group of one or more audio input channels, a second group of one or more audio input channels and meta-data comprising information on the position of the focus point, wherein the information on the position of the focus point is relative to a position of a listener, wherein the decoder is arranged to feed the first group of audio input channels into the basic channel provider, and wherein the basic channel provider is configured to provide the basic system audio channels to the loudspeakers of the basic system based on the first group of audio input channels, wherein the decoder is arranged to feed the second group of audio input channels and the information on the position of the focus point into the focused source renderer, and wherein the focused source renderer is configured to generate the at least three focus group audio channels based on the focus audio base signal, wherein the focus audio base signal depends on one or more audio input channels of the second group of audio input channels, wherein the decoder is configured to decode the data stream to obtain six channels of a 5.1 surround signal as the first group of audio input channels, wherein the decoder is arranged to feed the six channels of the 5.1 surround signal into the basic channel provider, and wherein the basic channel provider is configured to provide the six channels of the 5.1 surround signal to drive the loudspeakers of the basic system.

According to another embodiment, an apparatus for driving loudspeakers of a sound system, the sound system comprising at least two loudspeakers of a basic system, and at least three loudspeakers of a focus system, wherein each of the loudspeakers of the basic system and of the focus system has a position in an environment, may have: a basic channel provider for providing basic system audio channels to drive the loudspeakers of the basic system, a focused source renderer for providing focus system audio channels to drive the loudspeakers of the focus system, wherein the focused source renderer is configured to calculate a plurality of delay values for the loudspeakers of the focus system based on the positions of the loudspeakers of the focus system and based on a position of a focus point, wherein the focused source renderer is configured to generate at least three focus group audio channels for at least some of the loudspeakers of the focus system based on the plurality of delay values and based on a focus audio base signal to provide the focus system audio channels, wherein the apparatus furthermore comprises a decoder being configured to decode a data stream to obtain a first group of one or more audio input channels, a second group of one or more audio input channels and meta-data comprising information on the position of the focus point, wherein the information on the position of the focus point is relative to a position of a listener, wherein each of the audio input channels of the first group of audio input channels comprises basic channel information and first focus information, wherein each of the audio input channels of the second group of audio input channels comprises second focus information, wherein the decoder is configured to generate a third group of one or more modified audio channels based on the basic channel information of the first group of the audio input channels, wherein the decoder is arranged to feed the third group of modified audio channels into the basic channel provider, and wherein the basic channel provider is configured to provide the basic system audio channels to the loudspeakers of the basic system based on the third group of modified audio channels, wherein the decoder is configured to generate a fourth group of modified audio channels based on the first focus information of the first group of audio input channels and based on the second focus information of the second group of audio input channels, wherein the decoder is arranged to feed the fourth group of modified audio channels and the information on the position of the focus point into the focused source renderer, and wherein the focused source renderer is configured to generate the at least three focus group audio channels based on the focus audio base signal, wherein the focus audio base signal depends on one or more modified audio channels of the fourth group of modified audio channels, wherein the decoder is configured to decode the data stream to obtain six channels of a 5.1 surround signal as the first group of audio input channels, wherein the decoder is arranged to feed the six channels of the 5.1 surround signal into the basic channel provider, and wherein the basic channel provider is configured to provide the six channels of the 5.1 surround signal to drive the loudspeakers of the basic system.

According to another embodiment, a system may have: an apparatus as mentioned above, and at least one tracking unit, wherein the above apparatus is configured to receive a position of a listener from the at least one tracking unit, and wherein the above apparatus is adapted to shift the focus point depending on the position of the listener.

According to still another embodiment, a system may have: an encoding module as mentioned above, and an apparatus as mentioned above, wherein the basic audio mix signal is a surround audio mix signal, wherein the basic audio base signal is a surround audio base signal, wherein the subtractor is configured to subtract the focus downmix from the surround audio mix signal to obtain the surround audio base signal, and wherein the subtractor is configured to feed the surround audio base signal into the basic channel provider being a surround channel provider, wherein the above encoding module is configured to transmit a surround audio mix signal, a focus audio base signal and a position of a focus point as a data stream to the above apparatus, wherein the bitstream decoding unit of the above apparatus is configured to decode the data stream to obtain the surround audio mix signal, the focus audio base signal and the position of the focus point, wherein the decoder of the above apparatus is configured to feed the focus audio base signal and the position of the focus point into the focused source renderer of the above apparatus, wherein the downmix module of the above apparatus is configured to generate a focus downmix from the focus audio base signal and from the position of the focus point, wherein the subtractor of the above apparatus is configured to subtract the focus downmix from the surround audio mix signal to obtain a surround audio base signal, and wherein the subtractor of the above apparatus is configured to feed the surround audio base signal into the basic channel provider of the above apparatus, being a surround channel provider.

According to another embodiment, a sound system may have: a basic system comprising at least two loudspeakers, a focus system comprising at least three further loudspeakers, a first amplifier module, a second amplifier module, and an apparatus as mentioned above, wherein the first amplifier module is arranged to receive the basic system audio channels provided by the basic channel provider of the above apparatus, and wherein the first amplifier module is configured to drive the loudspeakers of the basic system based on the basic system audio channels, and wherein the second amplifier module is arranged to receive the focus system audio channels provided by the focused source renderer of the above apparatus, and wherein the second amplifier module is configured to drive the loudspeakers of the focus system based on the focus system audio channels.

According to another embodiment, a method for driving loudspeakers of a sound system, the sound system comprising at least two loudspeakers of a basic system, and at least three loudspeakers of a focus system, wherein each of the loudspeakers of the basic system and of the focus system has a position in an environment, may have the steps of: providing basic system audio channels to drive the loudspeakers of the basic system, providing focus system audio channels to drive the loudspeakers of the focus system, calculating a plurality of delay values for the loudspeakers of the focus system based on the positions of the loudspeakers of the focus system and based on a position of a focus point, and generating at least three focus group audio channels for at least some of the loudspeakers of the focus system based on the plurality of delay values and based on a focus audio base signal to provide the focus system audio channels, wherein generating the basic system audio channels is conducted based on the focus audio base signal and based on panning information for blending the focus audio base signal between the basic system and the focus system, and wherein generating the at least three focus group audio channels is conducted based on the focus audio base signal and based on the panning information for blending the focus audio base signal between the basic system and the focus system.

According to another embodiment, a method for driving loudspeakers of a sound system, the sound system comprising at least two loudspeakers of a basic system, and at least three loudspeakers of a focus system, wherein each of the loudspeakers of the basic system and of the focus system has a position in an environment, may have the steps of: providing basic system audio channels to drive the loudspeakers of the basic system, providing focus system audio channels to drive the loudspeakers of the focus system, calculating a plurality of delay values for the loudspeakers of the focus system based on the positions of the loudspeakers of the focus system and based on a position of a focus point, and generating at least three focus group audio channels for at least some of the loudspeakers of the focus system based on the plurality of delay values and based on a focus audio base signal to provide the focus system audio channels, wherein the focus audio base signal only comprises first frequency portions of an audio effect signal, wherein the first frequency portions only have frequencies which are higher than a first predetermined frequency value, and wherein at least some of the first frequency portions have frequencies which are higher than a second predetermined frequency value, wherein the second predetermined frequency value is higher than or equal to the first predetermined frequency value, and wherein generating the at least three focus group audio channels based on the focus audio base signal is conducted such that the focus group audio channels only have frequencies which are higher than the first predetermined frequency value.

According to another embodiment, a method for driving loudspeakers of a sound system, the sound system comprising at least two loudspeakers of a basic system, and at least three loudspeakers of a focus system, wherein each of the loudspeakers of the basic system and of the focus system has a position in an environment, may have the steps of: providing basic system audio channels to drive the loudspeakers of the basic system, providing focus system audio channels to drive the loudspeakers of the focus system, calculating a plurality of delay values for the loudspeakers of the focus system based on the positions of the loudspeakers of the focus system and based on a position of a focus point, and generating at least three focus group audio channels for at least some of the loudspeakers of the focus system based on the plurality of delay values and based on a focus audio base signal to provide the focus system audio channels, wherein the method may further have the steps of: receiving and filtering an audio effect signal to obtain a secondary effect signal and the focus audio base signal, such that the focus audio base signal is different from the audio effect signal, generating a first panned focus base signal and a second panned focus base signal by modifying the focus audio base signal depending on panning information, providing the focus system audio channels based on the first panned focus base signal, and providing the basic system audio channels based on the secondary effect signal and based on the second panned focus base signal.

According to another embodiment, a method for driving loudspeakers of a sound system, the sound system comprising at least two loudspeakers of a basic system, and at least three loudspeakers of a focus system, wherein each of the loudspeakers of the basic system and of the focus system has a position in an environment, may have the steps of: providing basic system audio channels to drive the loudspeakers of the basic system, providing focus system audio channels to drive the loudspeakers of the focus system, calculating a plurality of delay values for the loudspeakers of the focus system based on the positions of the loudspeakers of the focus system and based on a position of a focus point, and generating at least three focus group audio channels for at least some of the loudspeakers of the focus system based on the plurality of delay values and based on a focus audio base signal to provide the focus system audio channels, wherein the method may further have the steps of: decoding a data stream to obtain a basic audio mix signal, the focus audio base signal and the position of the focus point, generating a focus downmix from the focus audio base signal and from the position of the focus point, subtracting the focus downmix from the basic audio mix signal to obtain a basic audio base signal.

According to still another embodiment, a method for driving loudspeakers of a sound system, the sound system comprising at least two loudspeakers of a basic system, and at least three loudspeakers of a focus system, wherein each of the loudspeakers of the basic system and of the focus system has a position in an environment, may have the steps of: providing basic system audio channels to drive the loudspeakers of the basic system, providing focus system audio channels to drive the loudspeakers of the focus system, calculating a plurality of delay values for the loudspeakers of the focus system based on the positions of the loudspeakers of the focus system and based on a position of a focus point, and generating at least three focus group audio channels for at least some of the loudspeakers of the focus system based on the plurality of delay values and based on a focus audio base signal to provide the focus system audio channels, wherein the method may further have the steps of: decoding a data stream to obtain a first group of one or more audio input channels, a second group of one or more audio input channels and meta-data comprising information on the position of the focus point, wherein the information on the position of the focus point is relative to a position of a listener, providing the basic system audio channels to the loudspeakers of the basic system based on the first group of audio input channels, generating the at least three focus group audio channels based on the focus audio base signal, wherein the focus audio base signal depends on one or more audio input channels of the second group of audio input channels, wherein the data stream is decoded to obtain six channels of an HDMI audio signal as the first group of audio input channels and to obtain two further channels of the HDMI audio signal as the second group of audio input channels.

According to another embodiment, a method for driving loudspeakers of a sound system, the sound system comprising at least two loudspeakers of a basic system, and at least three loudspeakers of a focus system, wherein each of the loudspeakers of the basic system and of the focus system has a position in an environment, may have the steps of: providing basic system audio channels to drive the loudspeakers of the basic system, providing focus system audio channels to drive the loudspeakers of the focus system, calculating a plurality of delay values for the loudspeakers of the focus system based on the positions of the loudspeakers of the focus system and based on a position of a focus point, and generating at least three focus group audio channels for at least some of the loudspeakers of the focus system based on the plurality of delay values and based on a focus audio base signal to provide the focus system audio channels, wherein the method may further have the steps of: decoding a data stream to obtain a first group of one or more audio input channels, a second group of one or more audio input channels and meta-data comprising information on the position of the focus point, wherein the information on the position of the focus point is relative to a position of a listener, wherein each of the audio input channels of the first group of audio input channels comprises basic channel information and first focus information, wherein each of the audio input channels of the second group of audio input channels comprises second focus information, generating a third group of one or more modified audio channels based on the basic channel information of the first group of the audio input channels, providing the basic system audio channels to the loudspeakers of the basic system based on the third group of modified audio channels, generating a fourth group of modified audio channels based on the first focus information of the first group of audio input channels and based on the second focus information of the second group of audio input channels, generating the at least three focus group audio channels based on the focus audio base signal, wherein the focus audio base signal depends on one or more modified audio channels of the fourth group of modified audio channels, and decoding the data stream to obtain six channels of an HDMI audio signal as the first group of audio input channels and to obtain two further channels of the HDMI audio signal as the second group of audio input channels.

According to another embodiment, a method for driving loudspeakers of a sound system, the sound system comprising at least two loudspeakers of a basic system, and at least three loudspeakers of a focus system, wherein each of the loudspeakers of the basic system and of the focus system has a position in an environment, may have the steps of: providing basic system audio channels to drive the loudspeakers of the basic system, providing focus system audio channels to drive the loudspeakers of the focus system, calculating a plurality of delay values for the loudspeakers of the focus system based on the positions of the loudspeakers of the focus system and based on a position of a focus point, and generating at least three focus group audio channels for at least some of the loudspeakers of the focus system based on the plurality of delay values and based on a focus audio base signal to provide the focus system audio channels, wherein the method may further have the steps of: decoding a data stream to obtain a first group of one or more audio input channels, a second group of one or more audio input channels and meta-data comprising information on the position of the focus point, wherein the information on the position of the focus point is relative to a position of a listener, providing the basic system audio channels to the loudspeakers of the basic system based on the first group of audio input channels, generating the at least three focus group audio channels based on the focus audio base signal, wherein the focus audio base signal depends on one or more audio input channels of the second group of audio input channels, decoding the data stream to obtain six channels of a 5.1 surround signal as the first group of audio input channels, and providing the six channels of the 5.1 surround signal to drive the loudspeakers of the basic system.

According to another embodiment, a method for driving loudspeakers of a sound system, the sound system comprising at least two loudspeakers of a basic system, and at least three loudspeakers of a focus system, wherein each of the loudspeakers of the basic system and of the focus system has a position in an environment, may have the steps of: providing basic system audio channels to drive the loudspeakers of the basic system, providing focus system audio channels to drive the loudspeakers of the focus system, calculating a plurality of delay values for the loudspeakers of the focus system based on the positions of the loudspeakers of the focus system and based on a position of a focus point, and generating at least three focus group audio channels for at least some of the loudspeakers of the focus system based on the plurality of delay values and based on a focus audio base signal to provide the focus system audio channels, wherein the method may further have the steps of: decoding a data stream to obtain a first group of one or more audio input channels, a second group of one or more audio input channels and meta-data comprising information on the position of the focus point, wherein the information on the position of the focus point is relative to a position of a listener, wherein each of the audio input channels of the first group of audio input channels comprises basic channel information and first focus information, wherein each of the audio input channels of the second group of audio input channels comprises second focus information, generating a third group of one or more modified audio channels based on the basic channel information of the first group of the audio input channels, providing the basic system audio channels to the loudspeakers of the basic system based on the third group of modified audio channels, generating a fourth group of modified audio channels based on the first focus information of the first group of audio input channels and based on the second focus information of the second group of audio input channels, generating the at least three focus group audio channels based on the focus audio base signal, wherein the focus audio base signal depends on one or more modified audio channels of the fourth group of modified audio channels, decoding the data stream to obtain six channels of a 5.1 surround signal as the first group of audio input channels, and providing the six channels of the 5.1 surround signal to drive the loudspeakers of the basic system.

Another embodiment may have a computer program for implementing any of the above methods, when the computer program is executed by a computer or signal processor.

An apparatus for driving loudspeakers of a sound system is provided. The sound system comprises at least two loudspeakers of a basic system and at least three loudspeakers of a focus system. Each of the loudspeakers of the basic system and of the focus system has a position in an environment.

The apparatus comprises a basic channel provider for providing basic system audio channels to drive the loudspeakers of the basic system.

Moreover, the apparatus comprises a focused source renderer for providing focus system audio channels to drive the loudspeakers of the focus system. The focused source renderer is configured to calculate a plurality of delay values for the loudspeakers of the focus system based on the positions of the loudspeakers of the focus system and based on a position of a focus point. Furthermore, the focused source renderer is configured to generate at least three focus group audio channels for at least some of the loudspeakers of the focus system based on the plurality of delay values and based on a focus audio base signal to provide the focus system audio channels.

According to an embodiment, the focused source renderer may be configured to generate the at least three focus group audio channels for the at least some of the loudspeakers of the focus system based on the plurality of delay values and based on the focus audio base signal so that an audio output produced by the loudspeakers of the focus system, when being driven by the focus system audio channels, allows localizing the position of the focus point by a listener in the environment. For example, this in fact may mean that, e.g., according to such an embodiment, the focused source renderer is configured to generate the at least three focus group audio channels for the at least some of the loudspeakers of the focus system based on the plurality of delay values and based on the focus audio base signal so that an audio output produced by the loudspeakers of the focus system, when being driven by the focus system audio channels, allows localizing the focus audio base signal at the position of the focus point.

In an embodiment, the basic system may be a surround system, the sound system may comprise at least four speakers of the surround system as the at least two speakers of the basic system, and the basic channel provider may be a surround channel provider for providing surround system audio channels as the basic system audio channels to drive the loudspeakers of the surround system.

According to another embodiment, the basic system may be a stereo system, and the sound system may comprise two speakers of the stereo system as the at least two speakers of the basic system.

In a further embodiment, the basic system may be a 2.1 stereo system comprising two stereo loudspeakers and an additional subwoofer loudspeaker, and the sound system may comprise the two stereo loudspeakers of the 2.1 stereo system and the additional subwoofer loudspeaker as the at least two speakers of the basic system.

According to an embodiment, the focused source renderer may be adapted to generate the at least three focus group audio channels, so that the position of the focus point is closer to a position of a sweet spot in the environment than any other position of one of the loudspeakers of the basic system and so that the position of the focus point is closer to the position of the sweet spot than any other position of one of the loudspeakers of the focus system.

In another embodiment, the basic channel provider may be configured to generate the basic system audio channels based on the focus audio base signal and based on panning information for blending the focus audio base signal between the basic system and the focus system, and the focused source renderer may be configured to generate the at least three focus group audio channels based on the focus audio base signal and based on the panning information for blending the focus audio base signal between the basic system and the focus system.

According to an embodiment, the panning information may, for example, be a panning factor.

In an embodiment, the focus audio base signal may only comprise first frequency portions of an audio effect signal, wherein the first frequency portions only have frequencies which are higher than a first predetermined frequency value, and wherein at least some of the first frequency portions have frequencies which are higher than a second predetermined frequency value, wherein the second predetermined frequency value is higher than or equal to the first predetermined frequency value. The focused source renderer may be configured to generate the at least three focus group audio channels based on the focus audio base signal such that the focus group audio channels only have frequencies which are higher than a predefined frequency value. The basic channel provider may be configured to generate the basic system audio channels based on a secondary effect signal, wherein the secondary effect signal only comprises second frequency portions of the audio effect signal, wherein the second frequency portions only have frequencies which are lower than or equal to the second predetermined frequency value, and wherein at least some of the second frequency portions have frequencies which are lower than or equal to the first predetermined frequency value.

According to an embodiment, the second predetermined frequency value may be equal to the first predetermined frequency value.

According to another embodiment, the focused source renderer may be adapted to adjust channel levels of the focus system audio channels to drive the loudspeakers of the focus system.

In another embodiment, the focus system may comprise one or more sound bars, each of the sound bars comprising at least 3 loudspeakers in a single enclosure.

According to an embodiment, the focus system may be a Wave Field Synthesis system.

In another embodiment, the focus system may employ Higher Order Ambisonics.

According to a further embodiment, the surround system may be a 5.1 surround system.

According to a further embodiment, the surround system may be a sound system with 5.1 input and virtual surround functionality, e.g. by just representing the 5.1 reproduction through a single sound bar in front of the listener.

In a further embodiment, the plurality of the delay values may be a plurality of time delay values. The focused source renderer may be adapted to generate each of the focus group audio channels by time shifting the focus audio base signal by one of the time delays of the plurality of time delays.

According to a further embodiment, the plurality of the delay values may be a plurality of phase values. The focused source renderer may be adapted to generate each of the focus group audio channels by adding one of the phase values of the plurality of phase values to each phase value of a frequency-domain representation of the focus audio base signal.

In another embodiment, the focused source renderer may be configured to generate the at least three focus group audio channels for at least some of the loudspeakers of the focus system based on the plurality of delay values and based on the focus audio base signal to provide the focus system audio channels, so that sound waves emitted by the loudspeakers of the focus system, when being driven by the focus system audio channels, form a constructive superposition which creates a local maximum of a sum of energies of the sound waves in the focus point.

According to a further embodiment, the apparatus may furthermore comprise a decoder being configured to decode a data stream to obtain a first group of one or more audio input channels, a second group of one or more audio input channels and meta-data comprising information on the position of the focus point, wherein the information on the position of the focus point is relative to a position of a listener. The decoder may be arranged to feed the first group of audio input channels into the basic channel provider. The basic channel provider may be configured to provide the basic system audio channels to the loudspeakers based on the first group of audio input channels. Moreover, the decoder may be arranged to feed the second group of audio input channels and the information on the position of the focus point into the focused source renderer, and the focused source renderer may be configured to generate the at least three focus group audio channels based on the focus audio base signal, wherein the focus audio base signal depends on one or more audio input channels of the second group of audio input channels.

It should be noted that the data stream mentioned above may, according to an embodiment, be, for example, an audio data stream. It should furthermore be noted that when referring to a data stream in the following, such a data stream may according to some embodiments be, for example, an audio data stream. It should however be also noted that according to other embodiments, the above-mentioned data stream and the data streams mentioned in the following may, for example, be other kinds of data streams.

In another embodiment, the apparatus may furthermore comprise a decoder being configured to decode a data stream to obtain a first group of one or more audio input channels, a second group of one or more audio input channels and meta-data comprising information on the position of the focus point, wherein the information on the position of the focus point is relative to a position of a listener. Each of the audio input channels of the first group of audio input channels comprises basic channel information and first focus information, wherein each of the audio input channels of the second group of audio input channels comprises second focus information. The decoder may be configured to generate a third group of one or more modified audio channels based on the basic channel information of the first group of the audio input channels. Moreover, the decoder may be arranged to feed the third group of modified audio channels into the basic channel provider, and wherein the basic channel provider is configured to provide the basic system audio channels to the loudspeakers based on the third group of modified audio channels. Moreover, the decoder may be configured to generate a fourth group of modified audio channels based on the first focus information of the first group of audio input channels and based on the second focus information of the second group of audio input channels. Furthermore, the decoder may be arranged to feed the fourth group of modified audio channels and the information on the position of the focus point into the focused source renderer, and wherein the focused source renderer is configured to generate the at least three focus group audio channels based on the focus audio base signal, wherein the focus audio base signal depends on one or more modified audio channels of the fourth group of modified audio channels.

According to another embodiment, the decoder may be configured to decode the data stream to obtain six channels of an HDMI audio signal as the first group of audio input channels, and wherein the decoder is configured to decode the data stream to obtain two further channels of the HDMI audio signal as the second group of audio input channels and associated meta-data.

In another embodiment, the decoder may be configured to decode the data stream to obtain six channels of a 5.1 surround signal as the first group of audio input channels. The decoder may be arranged to feed the six channels of the 5.1 surround signal into the basic channel provider. Moreover, the basic channel provider may be configured to provide the six channels of the 5.1 surround signal to drive the loudspeakers of the basic system.

According to a further embodiment, the decoder may be configured to decode the data stream to obtain a plurality of spatial audio object channels (for details on spatial audio object channels, see [7]) of a plurality of encoded spatial audio objects. Moreover, the decoder may be configured to decode at least one object position information for at least one of the spatial audio object channels. Furthermore, the decoder may be arranged to feed the plurality of the spatial audio object channels and the at least one object position information into the focused source renderer. Moreover, the focused source renderer may be configured to calculate the plurality of delay values for the loudspeakers of the focus system based on the positions of the loudspeakers of the focus system and based on one of the at least one object position information representing information on the position of the focus point. Furthermore, the focused source renderer may be configured to generate the at least three focus group audio channels for at least some of the loudspeakers of the focus system based on the focus audio base signal, wherein the focus audio base signal depends on one or more of the plurality of the spatial audio object channels.

In a further embodiment, the focused source renderer may be configured to calculate the plurality of delay values as a first group of delay values. The position of the focus point may be a first position of a first focus point. Moreover, the focus audio base signal may be a first focus audio base signal. The focused source renderer may furthermore be configured to generate the at least three focus group audio channels as a first group of focus group audio channels. Moreover, the focused source renderer is furthermore configured to calculate a second group of delay values for the loudspeakers of the focus system based on the positions of the loudspeakers of the focus system and based on a second position of a second focus point. Further, the focused source renderer may furthermore be configured to generate a second group of at least three focus group audio channels for at least some of the loudspeakers of the focus system based on the plurality of delay values of the second group of delay values and based on a second focus audio base signal. Moreover, the focused source renderer may furthermore be configured to generate a third group of at least three focus group audio channels for at least some of the loudspeakers of the focus system, wherein each of the focus group audio channels of the third group of focus group audio channels is a combination of one of the focus group audio channels of the first group of focus group audio channels and one of the focus group audio channels of the second group of focus group audio channels. The focused source renderer may be adapted to provide the focus group audio channels of the third group of focus group audio channels as the focus system audio channels to drive the loudspeakers of the focus system.

Moreover, a sound system is provided. The sound system comprises a basic system comprising at least two loudspeakers, a focus system comprising at least three further loudspeakers, a first amplifier module, a second amplifier module, and an apparatus for driving loudspeakers according to one of the above-described embodiments. The first amplifier module is arranged to receive the basic system audio channels provided by the basic channel provider of the apparatus for driving loudspeakers. The first amplifier module is configured to drive the loudspeakers of the basic system based on the basic system audio channels. The second amplifier module is arranged to receive the focus system audio channels provided by the focused source renderer of the apparatus for driving loudspeakers. The second amplifier module is configured to drive the loudspeakers of the focus system based on the focus system audio channels.

Moreover, a method for driving loudspeakers of a sound system is provided. The sound system comprises at least two loudspeakers of a basic system, and at least three loudspeakers of a focus system, wherein each of the loudspeakers of the basic system and of the focus system has a position in an environment. The method comprises:

Providing basic system audio channels to drive the loudspeakers of the basic system.

Providing focus system audio channels to drive the loudspeakers of the focus system, Calculating a plurality of delay values for the loudspeakers of the focus system based on the positions of the loudspeakers of the focus system and based on a position of a focus point. And:

Generating at least three focus group audio channels for at least some of the loudspeakers of the focus system based on the plurality of delay values and based on a focus audio base signal to provide the focus system audio channels.

Moreover, a computer program for implementing the above-described method when being executed on a computer or signal processor is provided.

Embodiments describe an apparatus and a method to create additional sound effects to be used in combination with a regular surround sound system. This new system comprises a focus system and a regular surround system that together can be used to create audio content enriched with special proximity effects. Embodiments may also be used in interactive scenarios, e.g. when playing a video game, to place real-time calculated auditory events in the room and nearby the player's head while playing regular music and other more distant sound effects through the loudspeakers of the regular surround sound system.

Embodiments represent an upgrade for conventional surround systems that enables sound sources close to the head of the listener. A conventional surround system is able to reproduce the distance of a sound source from infinitely far apart from the listener up to the position of the loudspeaker. By adding a focus system, the area of distance reproduction will be extended up to the head of the listener. Additionally, the perception of the direction will be improved. Embodiments realize to put sound events next to the listener's ears and they will sound like they were physically there. These effects let the listener immerse deeper into the sound scene.

With these capabilities, embodiments cover a great range of possible applications. They can be used for video games, movies, television shows or broadcasting of sport events like soccer matches.

In case of video games, the focus system may be capable of conveying all those sounds that should be close to the listener. In a first-person shooter these sounds would be spoken instructions from team-mates, ricochets in a gunfight, explosions or nature sounds like wind and rain. In this application of embodiments, the listener gets a much stronger team feeling, deeper immersion and higher precision. The latter is very important when the gamer has to react very fast. In a conventional setup, spoken words like route descriptions in a racing game or voice chat in a multiplayer game are undefined and hard to understand, because they aren't located close to the ears. According to embodiments, the gamer does not have to concentrate to hear and understand the spoken assignments, he can react immediately.

Embodiments support the atmosphere of games, especially horror games benefit from closeness of sound effects. The gaming experience is much more realistic and intense when the listener hears that a ghost moves around his head and whispers into his ears. In contrast, in conventional systems, the ghost will remain at the loudspeaker position or beyond, disabling any movement towards the listener's head.

In applications with non-interactive media, embodiments can give the listener the feeling, that he is still in the thick of the action. In case of a soccer match that is broadcasted, the listener can hear a crowd of fans close to him while he also hears the soccer game from afar. The advantages of the invention in the area of gaming are also possible for movies.

In an embodiment of the invention, a focus system comprising a loudspeaker array, advantageously mounted in a single enclosure, is combined with a surround system (e.g.

5.1 or 7.1) comprising several single loudspeakers. This allows for reproducing regular surround audio with additional playback of auditory events placed in the area of the listener's head. The input of such a system would comprise of regular 5.1 or 7.1 audio and one or more audio channels along with meta-data about where to position additional auditory events nearby the listener.

The auditory events added to the 5.1/7.1 channels are either rendered exclusively to the focus audio system, the surround system or might be reproduced on both audio systems. An auditory event can therefore move between the two systems, e.g. by blending the audio signal from one audio system to the other, depending on whether it is intended to be placed nearby the listener or placed farer away.

Embodiments concentrate on the focus effects that really make a difference in experience and perception. If the focus sources are meant to be reproduced only in the surrounding of the listener's head, a full ring of closely spaced WFS loudspeakers all around the room is not needed. Instead, one or more sound bars can be used for reproduction of the focus effects while all other audio can be played back using a regular surround setup which is able to reproduce audio signals all around the listener with a low number of speakers compared to a WFS system, leading to less effort in the implementation.

Embodiments are not required to utilize the precedence effect of the WFS system but rather render additional auditory events as focused sources to audio reproduced through the surround loudspeakers.

According to some embodiments, components of some of the above-described embodiments may be combined with components described in the known art and/or may be combined with approaches described in the known art. For example, the approaches presented in [5] could be used as a component of embodiments.

BRIEF DESCRIPTION OF THE DRAWINGS

In the following, embodiments of the present invention are described in more detail with reference to the figures, in which.

DETAILED DESCRIPTION OF THE INVENTION

Figure 1A:
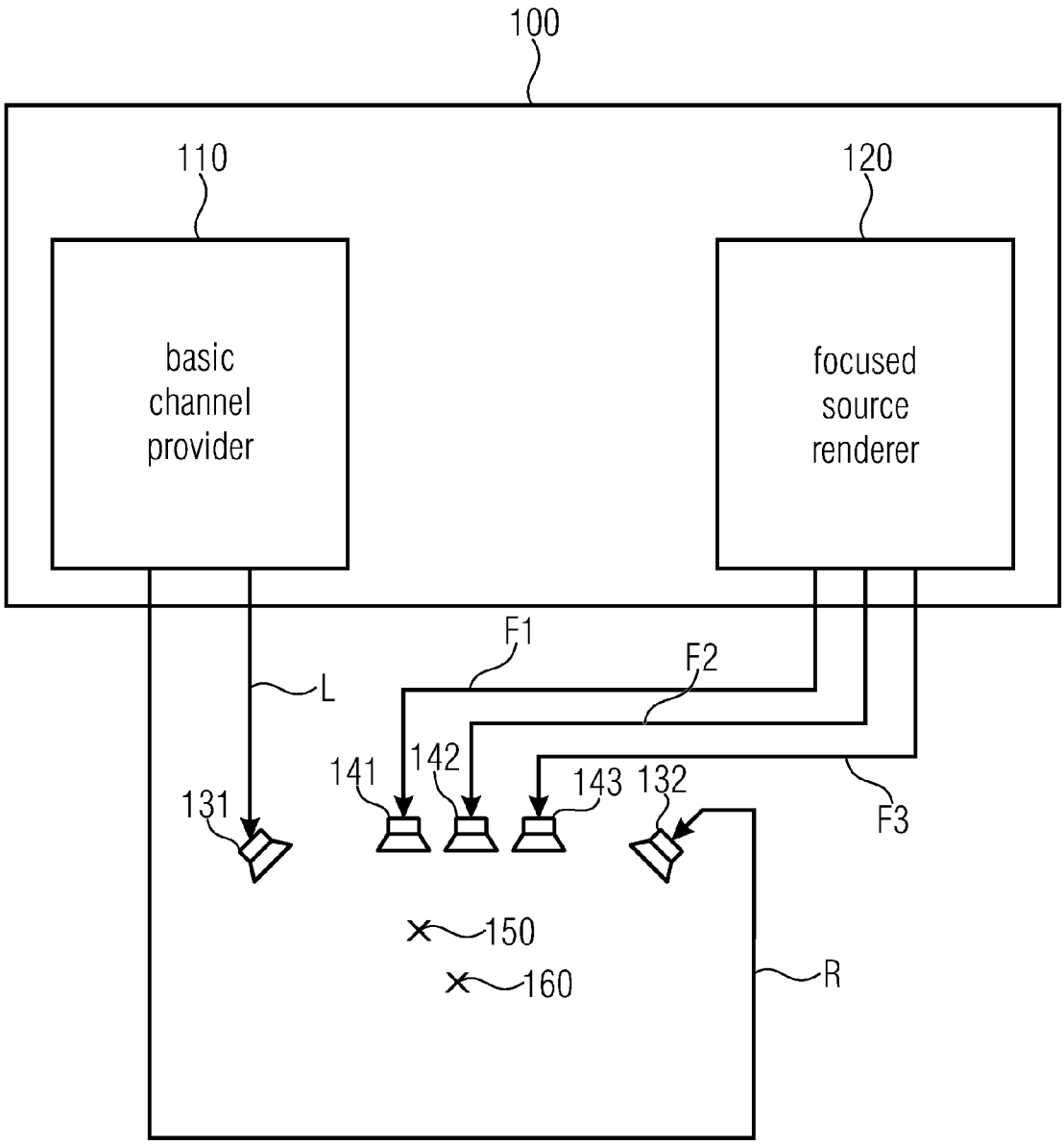
FIG. 1*a* illustrates an apparatus for driving loudspeakers of a sound system according to an embodiment.

FIG. 1*a* illustrates apparatus 100 for driving loudspeakers of a sound system. The sound system comprises at least two loudspeakers 131, 132 of a basic system and at least three loudspeakers of a focus system 141, 142, 143. Each of the loudspeakers of the basic system and of the focus system has a position in an environment.

The apparatus 100 comprises a basic channel provider 110 for providing basic system audio channels L, R to drive the loudspeakers 131, 132 of the basic system.

Moreover, the apparatus 100 comprises a focused source renderer 120 for providing focus system audio channels F1, F2, F3 to drive the loudspeakers 141, 142, 143 of the focus system. The focused source renderer 120 is configured to calculate a plurality of delay values for the loudspeakers 141, 142, 143 of the focus system based on the positions of the loudspeakers 141, 142, 143 of the focus system and based on a position of a focus point 150. Furthermore, the focused source renderer 120 is configured to generate at least three focus group audio channels for at least some of the loudspeakers 141, 142, 143 of the focus system based on the plurality of delay values and based on a focus audio base signal to provide the focus system audio channels F1, F2, F3.

According to an embodiment, the focused source renderer 120 is configured to generate the at least three focus group audio channels for the at least some of the loudspeakers 141, 142, 143 of the focus system based on the plurality of delay values and based on the focus audio base signal so that an audio output produced by the loudspeakers 141, 142, 143 of the focus system, when being driven by the focus system audio channels F1, F2, F3 allows localizing the position of the focus point by a listener in the environment.

The focused source renderer 120 may receive a focus audio base signal and may furthermore be aware of the positions of the loudspeakers of the focus system. The focused source renderer may moreover receive information about the position of a focus point 150.

Figure 2:
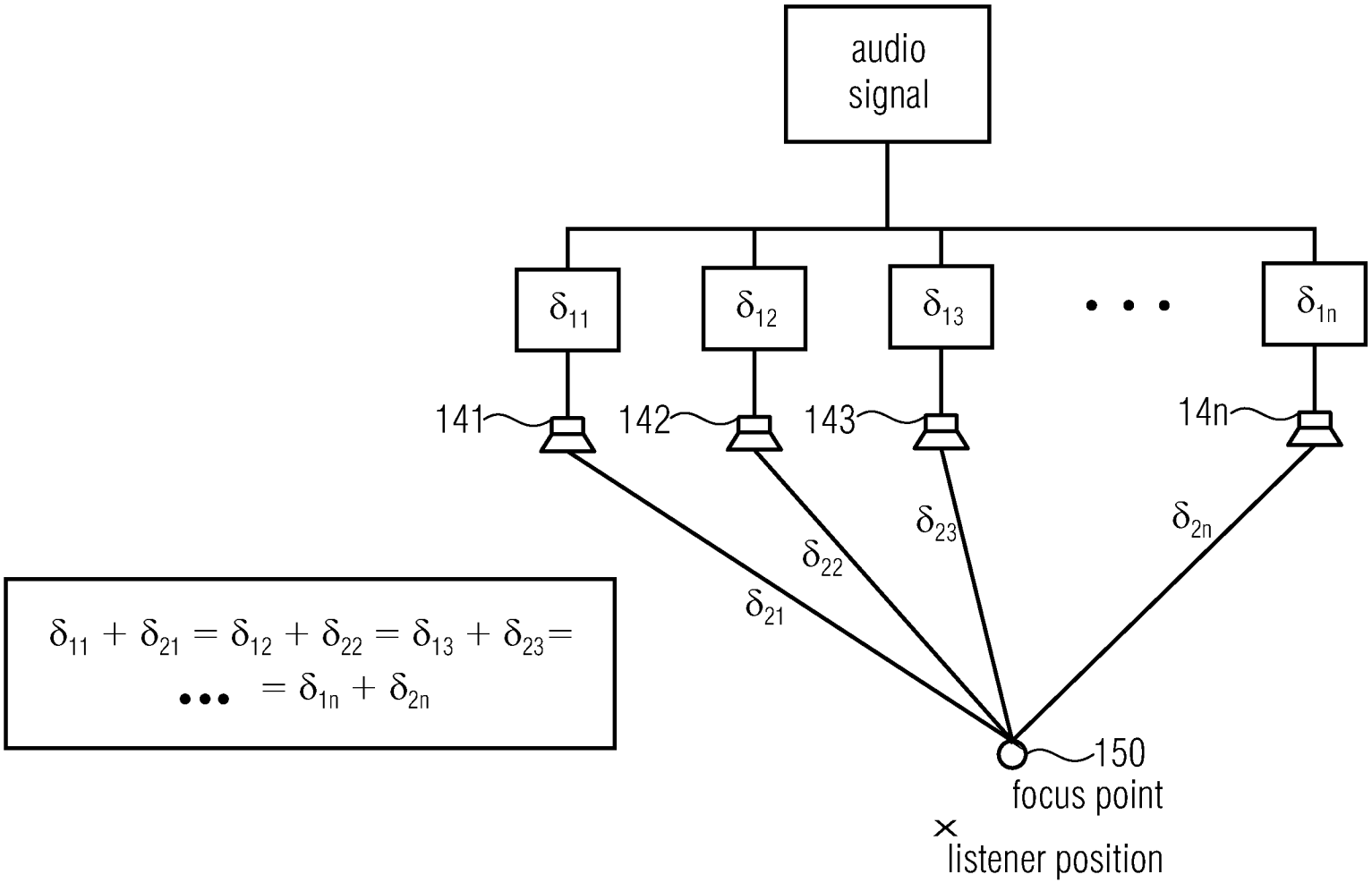
FIG. 2 illustrates a plurality of loudspeakers of a focus system according to an embodiment.

FIG. 2 illustrates a plurality of loudspeakers 141, 142, 143, . . . , 14*n* of a focus system according to an embodiment.

In particular, FIG. 2 illustrates a basic idea of driving the loudspeakers of the focus system to create a focus effect. The basic idea for creating a focus effect is, that the delay of a loudspeaker signal plus the time a sound wave, emitted by the loudspeaker, needs to reach the focus point should be equal for all loudspeakers. In this case, it is ensured that the greatest possible constructive superposition of all sound waves of all loudspeakers happens in the focus point for all frequency ranges.

For example, let $\delta_{21}$ be the time which a first sound wave emitted by the first loudspeaker 141 of the focus system needs to reach the focus point 150. Let $\delta_{11}$ be a first delay value calculated by the focused source renderer 120. A first channel for the first loudspeaker 141 of the focus system will be delayed by the calculated delay $\delta_{11}$, and so, a first total delay $\delta 1$ is: $\delta 1=\delta_{11}+\delta_{21}$.

Moreover, let $\delta_{22}$ be the time which a second sound wave emitted by the second loudspeaker 142 of the focus system needs to reach the focus point 150. Let $\delta_{12}$ be a second delay value calculated by the focused source renderer 120. A second channel for the second loudspeaker 142 of the focus system will be delayed by the calculated delay $\delta_{12}$, and so, a second total delay $\delta 2$ is: $\delta 2=\delta_{12}+\delta_{22}$.

The focused source renderer 120 may calculate the first delay value $\delta_{11}$ and the second delay value $\delta_{12}$ so that the first sound wave as well as the second sound wave arrive at the focus point 150 at the same time, so that $\delta 1=\delta 2$; or: $\delta_{11}+\delta_{21}=\delta_{12}+\delta_{22}$.

The delay values $\delta_{13}, \ldots, \delta_{1N}$ for the other loudspeakers 143, . . . , 14*n* of the focus system may be calculated accordingly, so that the for the total delays: $\delta 1=\delta 2=\delta 3= \ldots =\delta N$; or, in other words, so that: $\delta_{11}+\delta_{21}=\delta_{12}+\delta_{22}=\delta_{13}+\delta_{23}= \ldots =\delta_{1n}+\delta_{2n}$.

The focused source renderer 120 is configured to generate the at least three focus group audio channels for the at least some of the loudspeakers 141, 142, 143 of the focus system based on the plurality of delay values $\delta 1$, $\delta 2$, $\delta 3$ and based on a focus audio base signal.

For example, according to some embodiments, the plurality of the delay values $\delta 1$, $\delta 2$, $\delta 3$ is a plurality of time delay values. The focused source renderer 120 is adapted to generate each of the focus group audio channels (focus audio channels) by time shifting the focus audio base signal by one of the time delays of the plurality of time delays. For example, each of the focus group audio channels may represent the focus audio base signal, time-shifted by a different time delay value $\delta 1$, $\delta 2$, $\delta 3$ or $\delta n$, wherein the time-delay value is specific for the considered loudspeaker 141, 142, 143 or 14*n* of the focus system.

However, in another embodiment, the focus audio base signal may be represented in a frequency domain. For example, in such a case, the plurality of the delay values $\delta 1$, $\delta 2$, $\delta 3$ may be a plurality of phase values. The focused source renderer 120 may be adapted to generate each of the focus group audio channels by adding one of the phase values of the plurality of phase values to each phase value of a frequency-domain representation of the focus audio base signal.

In some embodiments, the focused source renderer 120 is configured to generate the at least three focus group audio channels for at least some of the loudspeakers 141, 142, 143 of the focus system based on the plurality of delay values $\delta 1$, $\delta 2$, $\delta 3$ and based on the focus audio base signal, so that sound waves emitted by the loudspeakers of the focus system, when being driven by the focus system audio channels F1, F2, F3, form a constructive superposition which creates a local maximum of a sum of energies of the sound waves in the focus point.

The focused source renderer 120 generates the at least three focus group audio channels for at least some of the loudspeakers of the focus system to provide the focus system audio channels F1, F2, F3 for driving the loudspeakers of the focus system.

In some embodiments, the generated focus group audio channels may be (identical to) the focus system audio channels.

Figure 3A:
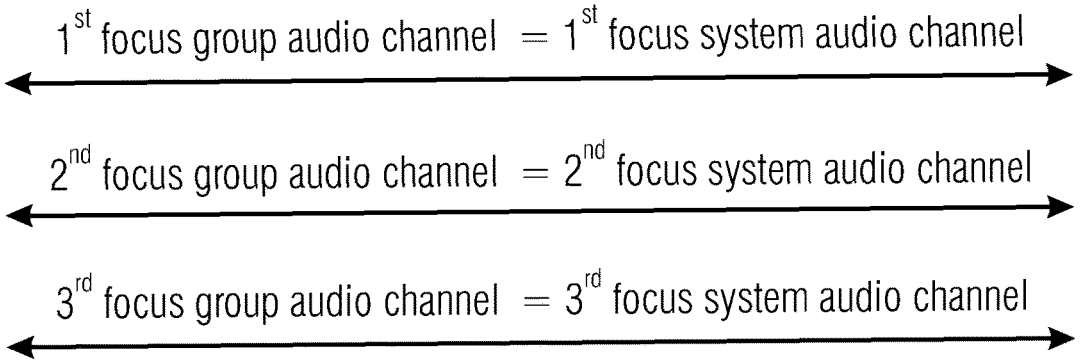
FIG. 3*a* illustrates a relation between the focus system audio channels and the focus group audio channels according to a particular embodiment.

FIG. 3*a* illustrates a relation between the focus system audio channels and the focus group audio channels according to a particular embodiment, where the generated focus group audio channels are identical to the focus system audio channels.

However, in other embodiments, the focus group audio channels may only be used to generate the focus system audio channels.

For example, the loudspeakers 141, 142, 143, . . . , 14*n* of the focus system may reproduce, besides the audio content of the focus group audio channels, furthermore other audio content of one or more other audio signals. Each of the focus system audio channels may then result from a combination of the respective focus group audio channel and one of the one or more other audio signals.

In an embodiment, a combiner 171, 172, 173 (see FIG. 3*b*) exists for each of the loudspeakers 141, 142, 143, . . . , 14*n* of the focus system and each combiner combines the respective focus group audio channel for the respective loudspeaker 141, 142, 143, . . . , 14*n* of the focus system and one of the other audio signals, wherein exactly one of the other audio signals is assigned to each of the loudspeakers 141, 142, 143, . . . , 14*n* of the focus system.

In an embodiment, each of the combiners 171, 172, 173 may moreover receive combination information, for example, one or more mixing coefficients to steer the mixing of the focus group audio channels and the one of the other audio signals. E.g., possibly, the combining information is sufficient when it is clear that the structure of FIG. 3*b* can be applied multiple times.

The focus system audio channels may result from a combination of the respective focus group audio channel and one of the one or more other audio signals, wherein each of the other audio signals is specific for one of the loudspeakers 141, 142, 143, . . . , 14*n* of the focus system.

Figure 3B:
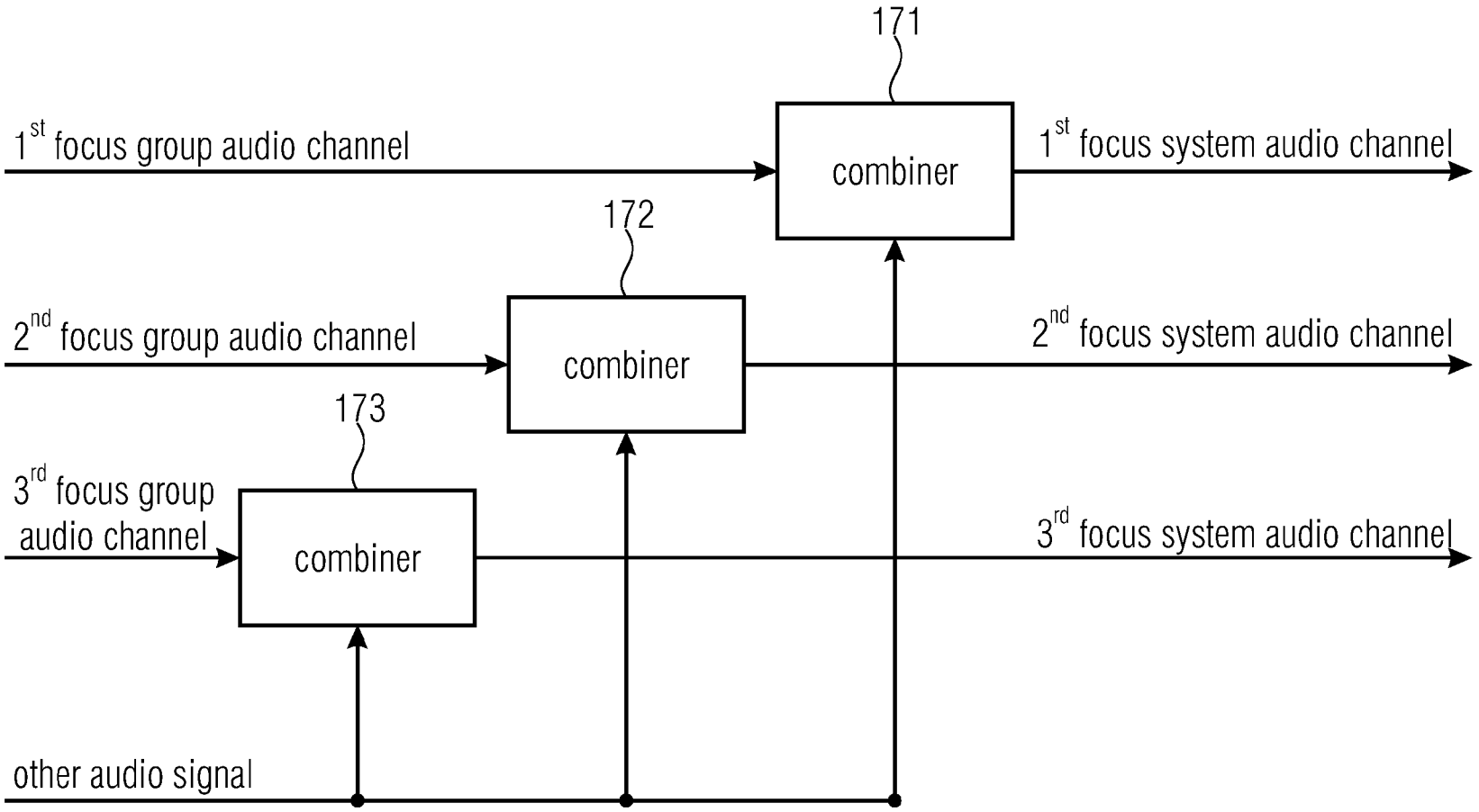
FIG. 3*b* illustrates another relation between the focus system audio channels and the focus group audio channels according to another particular embodiment.

FIG. 3*b* illustrates as an example a relation between the focus system audio channels and the focus group audio channels of such an embodiment, where the first focus system audio channel results from a combination conducted by a first combiner 171 of the first focus group audio channel and another audio signal, where the second focus system audio channel results from a combination conducted by a second combiner 172 of the second focus group audio channel and the other audio signal, and where the third focus system audio channel results from a combination conducted by a third combiner 173 of the third focus group audio channel and the other audio signal.

Or, in another embodiment, for example, the focused source renderer 120 may generate a first group of focus group audio channels to create a first focus effect at a first focus point. Moreover, at the same time, the focused source renderer 120 may generate a second group of focus group audio channels to create a second focus effect at a second focus point. For each loudspeaker 141, 142, 143 of the focus system, the audio content of the focus group audio channel of said loudspeaker of the first group and the audio content of the focus group audio channel of said loudspeaker of the second group may be reproduced at the same time by said loudspeaker. For example, the focused source renderer 120 may generate a combination signal combining for each loudspeaker of the focus system the focus group audio channel of said loudspeaker of the first group and the focus group audio channel of said loudspeaker of the second group. The combination signals of the loudspeakers of the focus system may then be considered as a third group of focus group audio channels. The audio channels of the third group of focus group audio channels may then be the focus system audio channels. For example, the first, second and third group of focus group audio channels may each comprise at least three focus group audio channels.

Figure 3C:
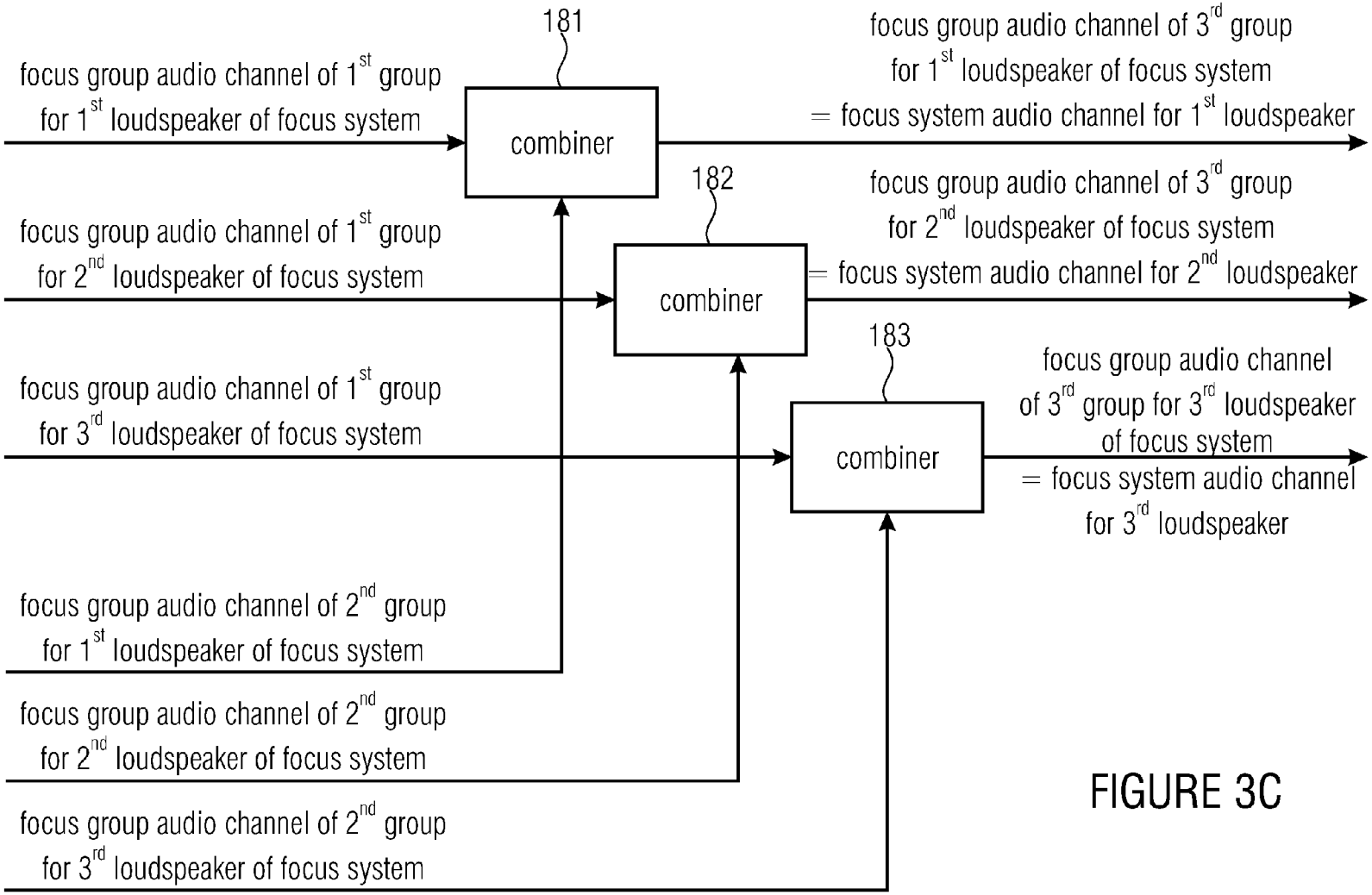
FIG. 3*c* illustrates another relation between the focus system audio channels and the focus group audio channels according to a further particular embodiment.

FIG. 3*c* illustrates as an example a relation between the focus system audio channels and the focus group audio channels according to such an embodiment.

A first combiner 181 is configured to combine a focus group audio channel of a first group of focus group audio channels for a first loudspeaker of the focus system and a focus group audio channel of a second group of focus group audio channels for the first loudspeaker of the focus system to obtain a focus group audio channel of a third group of focus group audio channels for the first loudspeaker of the focus system. Said focus group audio channel of the third group of focus group audio channels for the first loudspeaker of the focus system is the focus system audio channel for the first loudspeaker of the focus system.

A second combiner 182 is configured to combine a focus group audio channel of a first group of focus group audio channels for a second loudspeaker of the focus system and a focus group audio channel of a second group of focus group audio channels for the second loudspeaker of the focus system to obtain a focus group audio channel of a third group of focus group audio channels for the second loudspeaker of the focus system. Said focus group audio channel of the third group of focus group audio channels for the second loudspeaker of the focus system is the focus system audio channel for the second loudspeaker of the focus system.

A third combiner 183 is configured to combine a focus group audio channel of a first group of focus group audio channels for a third loudspeaker of the focus system and a focus group audio channel of a second group of focus group audio channels for the third loudspeaker of the focus system to obtain a focus group audio channel of a third group of focus group audio channels for the third loudspeaker of the focus system. Said focus group audio channel of the third group of focus group audio channels for the third loudspeaker of the focus system is the focus system audio channel for the third loudspeaker of the focus system.

According to an embodiment, the basic system 110 is a stereo system, and the sound system may comprise two speakers 131, 132 of the stereo system as the at least two speakers of the basic system.

According to a particular embodiment, the focused source renderer 120 may, for example, be adapted to generate the at least three focus group audio channels, F1, F2, F3 so that the position of the focus point 150 is closer to a position of a sweet spot 160 in the environment than any other position of one of the loudspeakers 131, 132 of the basic system and so that the position of the focus point 150 is closer to the position of the sweet spot 160 than any other position of one of the loudspeakers 141, 142, 143 of the focus system.

Figure 1B:
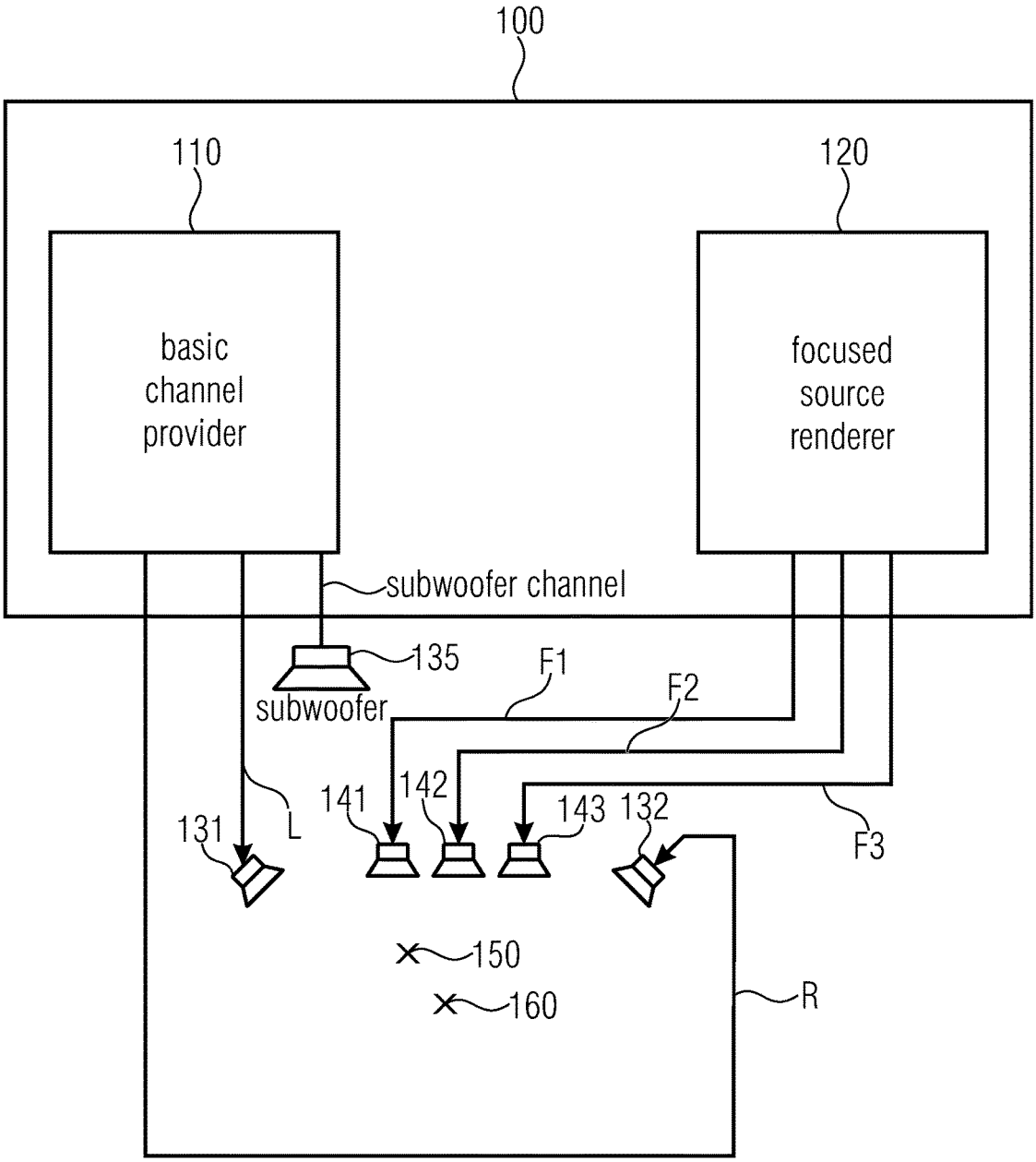
FIG. 1*b* illustrates an apparatus for driving loudspeakers of a sound system according to another embodiment.

FIG. 1*b* illustrates a further embodiment of an apparatus 100 for driving loudspeakers of a sound system according to an embodiment. The basic system is a 2.1 stereo system comprising two stereo loudspeakers 131, 132 and an additional subwoofer loudspeaker 135. The sound system comprises the two stereo loudspeakers 131, 132 and the additional subwoofer loudspeaker 135 of the 2.1 stereo system as the at least two speakers of the basic system.

Figure 1C:
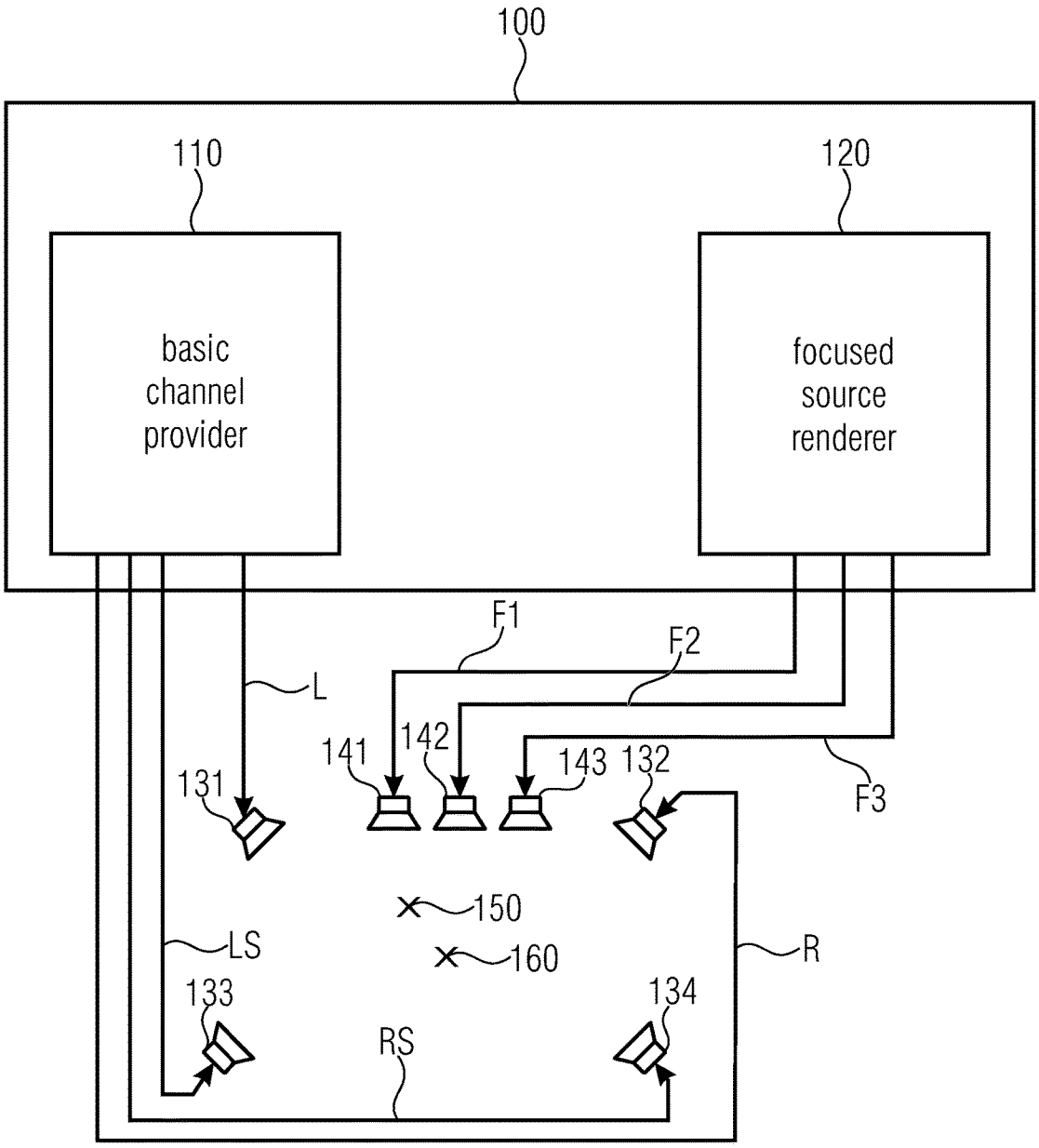
FIG. 1*c* illustrates an apparatus for driving loudspeakers of a sound system according to a further embodiment, FIG. 1*d* provides another illustration of an apparatus for driving loudspeakers of a sound system according to an embodiment.

FIG. 1*c* illustrates an apparatus 100 for driving loudspeakers of a sound system according to another embodiment. In the embodiment illustrated by FIG. 1*c*, the basic system is a surround system. The sound system comprises at least four speakers 131, 132, 133, 134 of the surround system as the at least two speakers of the basic system, and the basic channel provider may be a surround channel provider for providing surround system audio channels L, R, LS, RS as the basic system audio channels to drive the loudspeakers 131, 132, 133, 134 of the surround system.

Figure 1D:
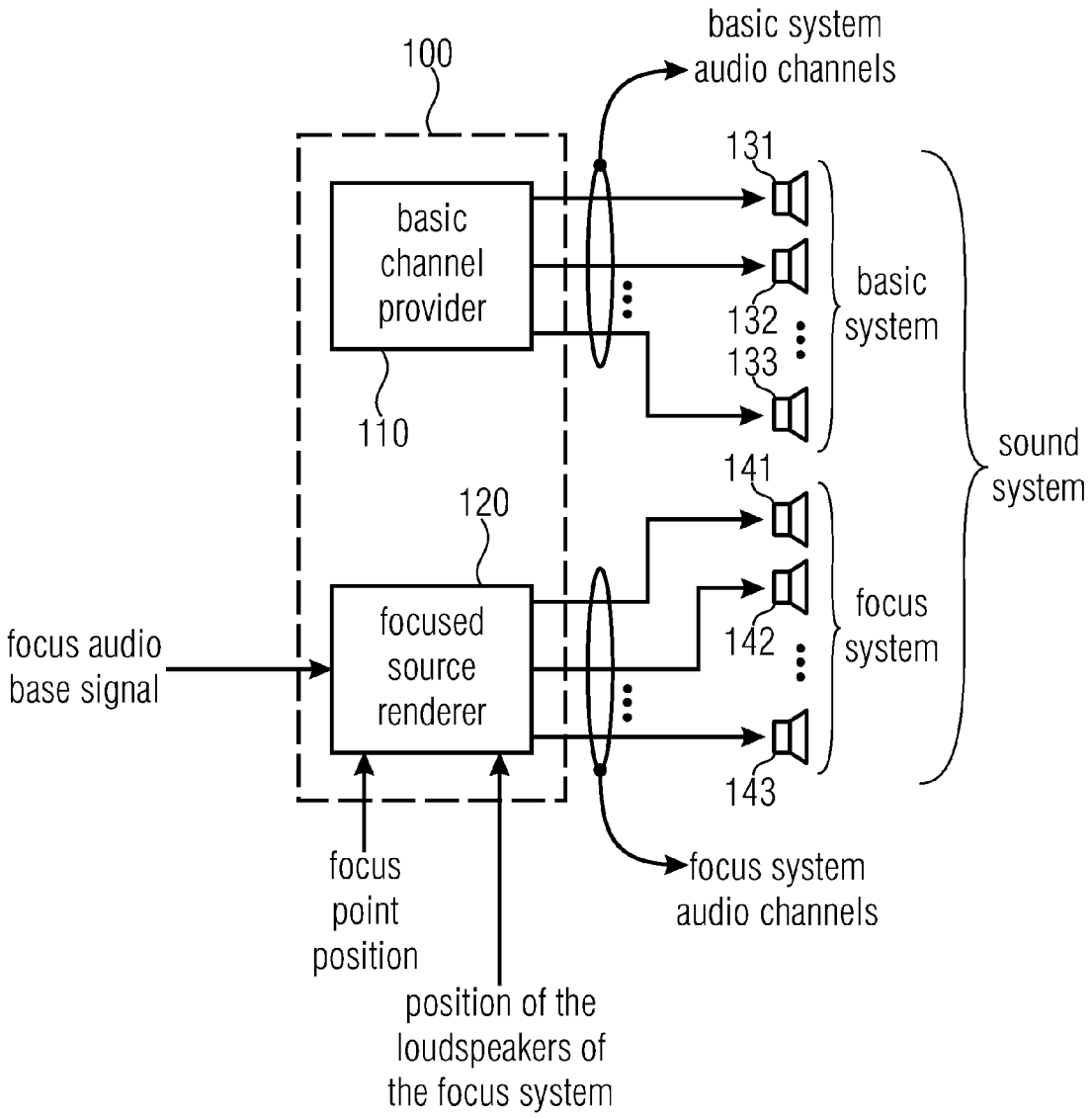
FIG. 1*e* illustrates an apparatus for driving loudspeakers of a sound system according to another embodiment, wherein the basic channel provider and the focused source renderer are configured to receive a panning factor.
FIG. 1*f* illustrates an apparatus for driving loudspeakers of a sound system according to an embodiment, wherein the apparatus comprises a filter unit.
FIG. 1*g* illustrates an apparatus for driving loudspeakers of a sound system according to an embodiment, wherein the apparatus comprises a filter unit and a panner.

FIG. 1*d* provides another illustration of an apparatus 100 for driving loudspeakers of a sound system according to an embodiment. The basic channel provider 110 of the apparatus provides the basic system audio channels to the loudspeakers 131, 132, 134 of the basic system. The focused source renderer 120 of the apparatus receives a focus audio base signal, a focus point position and positions of the loudspeakers 141, 142, 143 of the focus system. The focused source renderer provides the focus system audio channels to the loudspeakers 141, 142, 143 of the focus system.

In another embodiment, the focus system comprises one or more sound bars, each of the sound bars comprising at least 3 loudspeakers in a single enclosure.

Figure 4A:
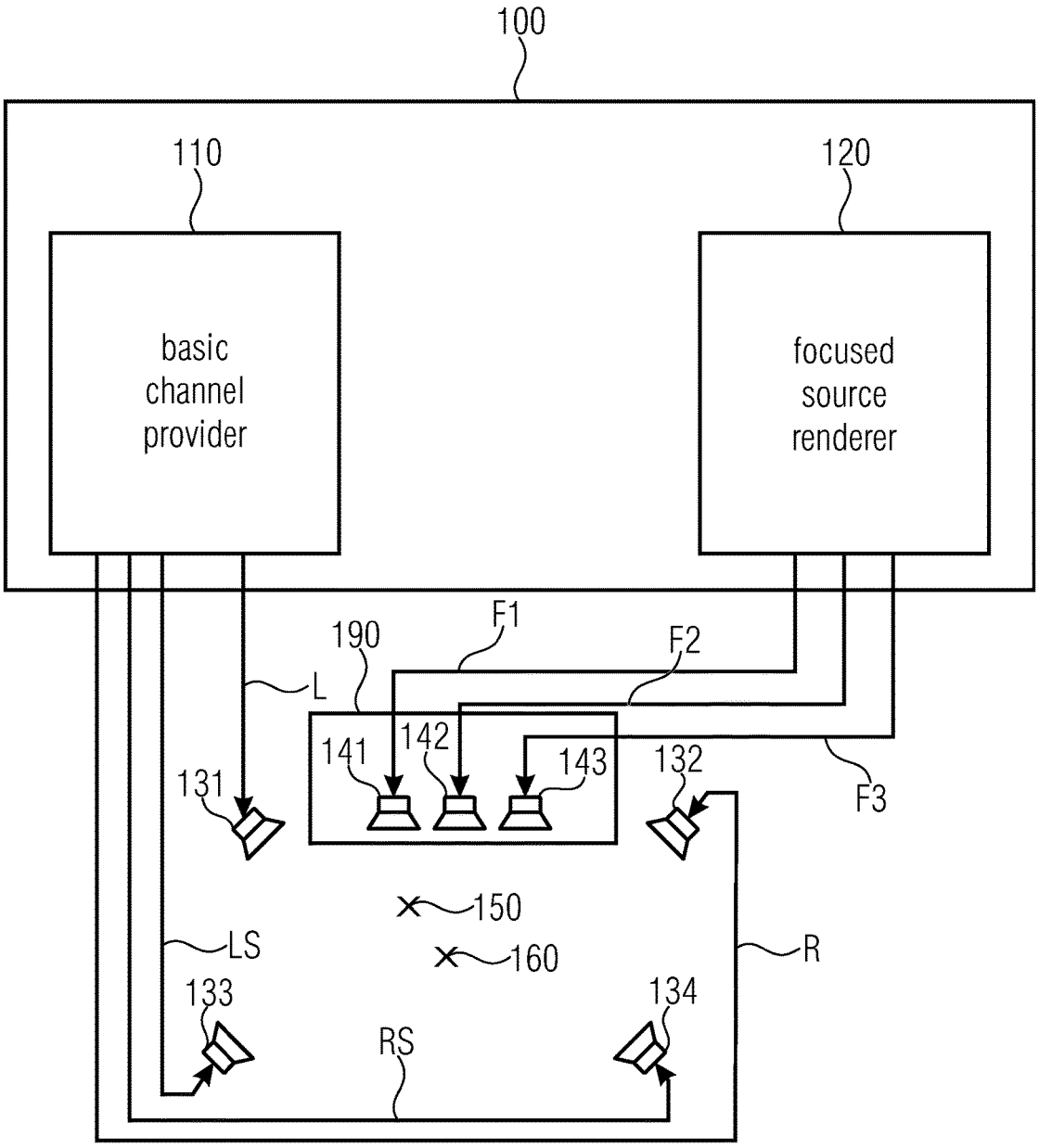
FIG. 4*a* illustrates an apparatus for driving loudspeakers of a sound system, wherein the focus system comprises a sound bar.

FIG. 4*a* illustrates such a sound bar 190 in an embodiment. The sound bar 190 comprises the three loudspeakers 141, 142, 143 of the focus system.

According to some embodiments, one or more focused sources are generated by steering sound energy from several loudspeakers into the room nearby the listener while playing back the main portion of audio through a conventional sound system (basic sound system). Since several loudspeakers with known relative position to each other may be needed to create focused sources, these loudspeakers may, for example, be mounted as an array in a single enclosure ("sound bar"). Since the reproduction of a focused source is only possible if the focus point is configured to be between the listener and the sound bar, multiple sound bars can be used to increase the reproduction area where focused sources can be placed around the listener position.

Figure 4B:
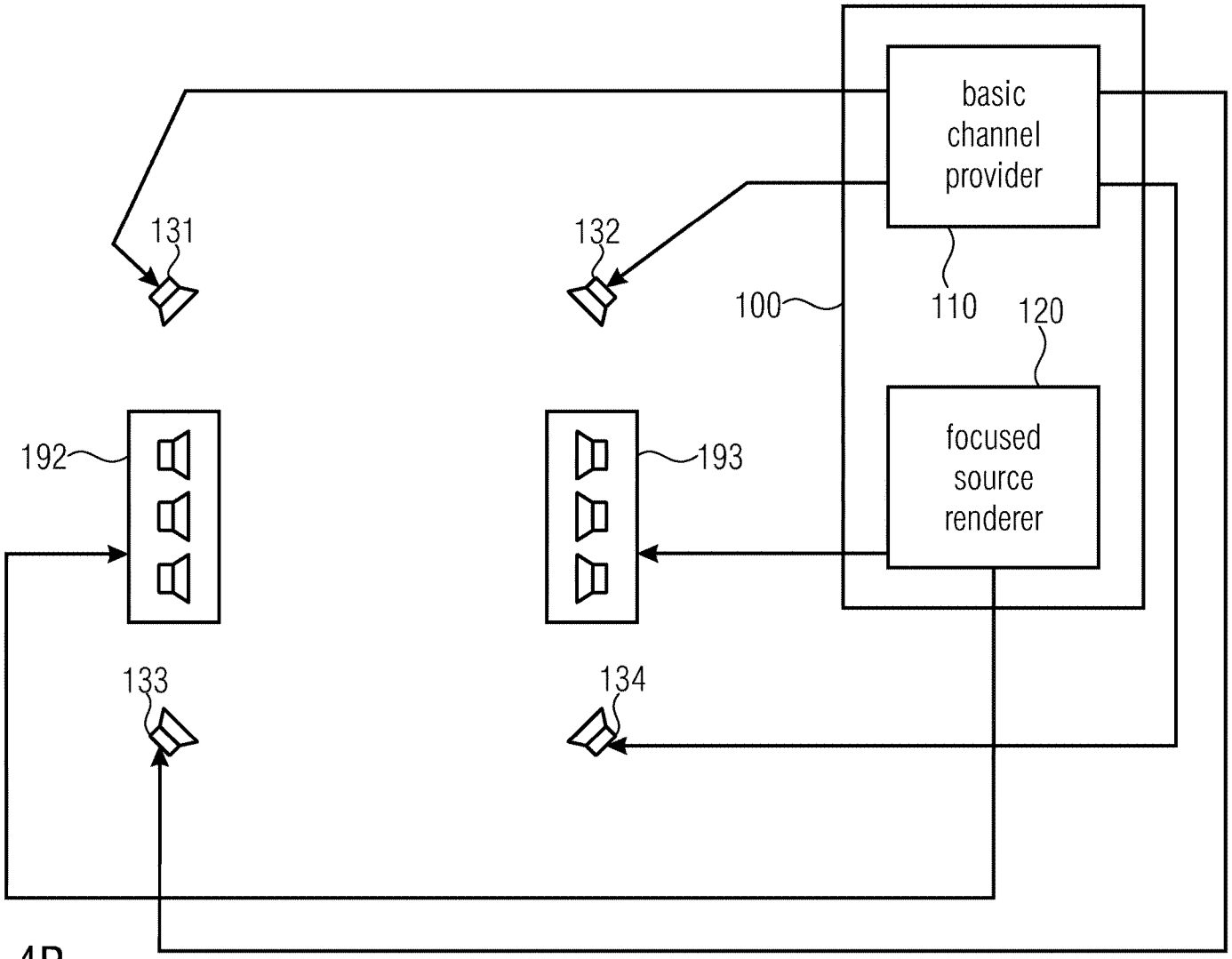
FIG. 4*b* illustrates an apparatus for driving loudspeakers of a sound system, wherein the focus system comprises four sound bars.

In an embodiment of the invention illustrated by FIG. 4*b*, the focus system comprises two sound bars that are placed on the left and right walls of the room (relative to the listener). This will enable the generation of a strong focus point for the left and right ear, respectively.

FIG. 4*b* illustrates an apparatus 100 for driving loudspeakers of a sound system, wherein the sound system comprises two sound bars 192, 193. The basic channel provider 110 is configured to provide basic system audio channels to drive the loudspeakers 131, 132, 133, 134 of the basic system. The focused source renderer 120 is configured to provide focus system audio channels to the sound bars 192, 193 to drive the loudspeakers of the focus system. The loudspeakers of the focus system are comprised by the two sound bars 192, 193.

In other embodiments, the focus system comprises more than two sound bars, e.g. three, four or more sound bars.

It is also possible to use less or more sound bars to reproduce the proximity effects. For example, a single sound bar might be placed in front of the listener or even overhead. When using four sound bars, the advantageous placement would be to mount one bar on each of the four walls of a rectangular room (front, back, left, right).

Especially when using only one or two sound bars, the rendering algorithm might need to take into account that the possible reproduction area of focused sound sources might be limited. The effort for building a sound system that integrates bars for proximity effects can therefore be scaled. Usually, a lower number of loudspeakers for the focus sound system will result in a less effective proximity illusion.

In embodiments, the audio signals of both audio systems, the focus system and the basic system, in combination produce an immersive audio scene. The proximate signals may be played back through the focus system while sources farer away or more ambient sounds are reproduced using the basic system.

According to another embodiment, the focused source renderer 120 is adapted to adjust channel levels of the focus system audio channels F1, F2, F3 to drive the loudspeakers of the focus system.

In another embodiment, the basic channel provider 110 is configured to generate the basic system audio channels L, R, LS, RS based on the focus audio base signal and based on a panning factor $\alpha$ for blending the focus audio base signal between the basic system and the focus system. The focused source renderer 120 is configured to generate the at least three focus group audio channels based on the focus audio base signal and based on the panning factor $\alpha$ for blending the focus audio base signal between the basic system and the focus system.

For example, according to some embodiments, it is possible to move an auditory event from the basic system to the focus system and from the focus system to the basic system. This can be done by introducing a blend factor for panning the auditory event between the sound bar and the basic system, e.g. a surround system (surround setup). An example for that effect would be having a sound starting in one direction in the distance, being rendered with conventional panning techniques through the surround system, that then gets panned to the sound bar, flying through the room and passing the head of the listener. Finally, the sound could be panned back to the conventional surround setup to appear more distant again.

Figure 1E:
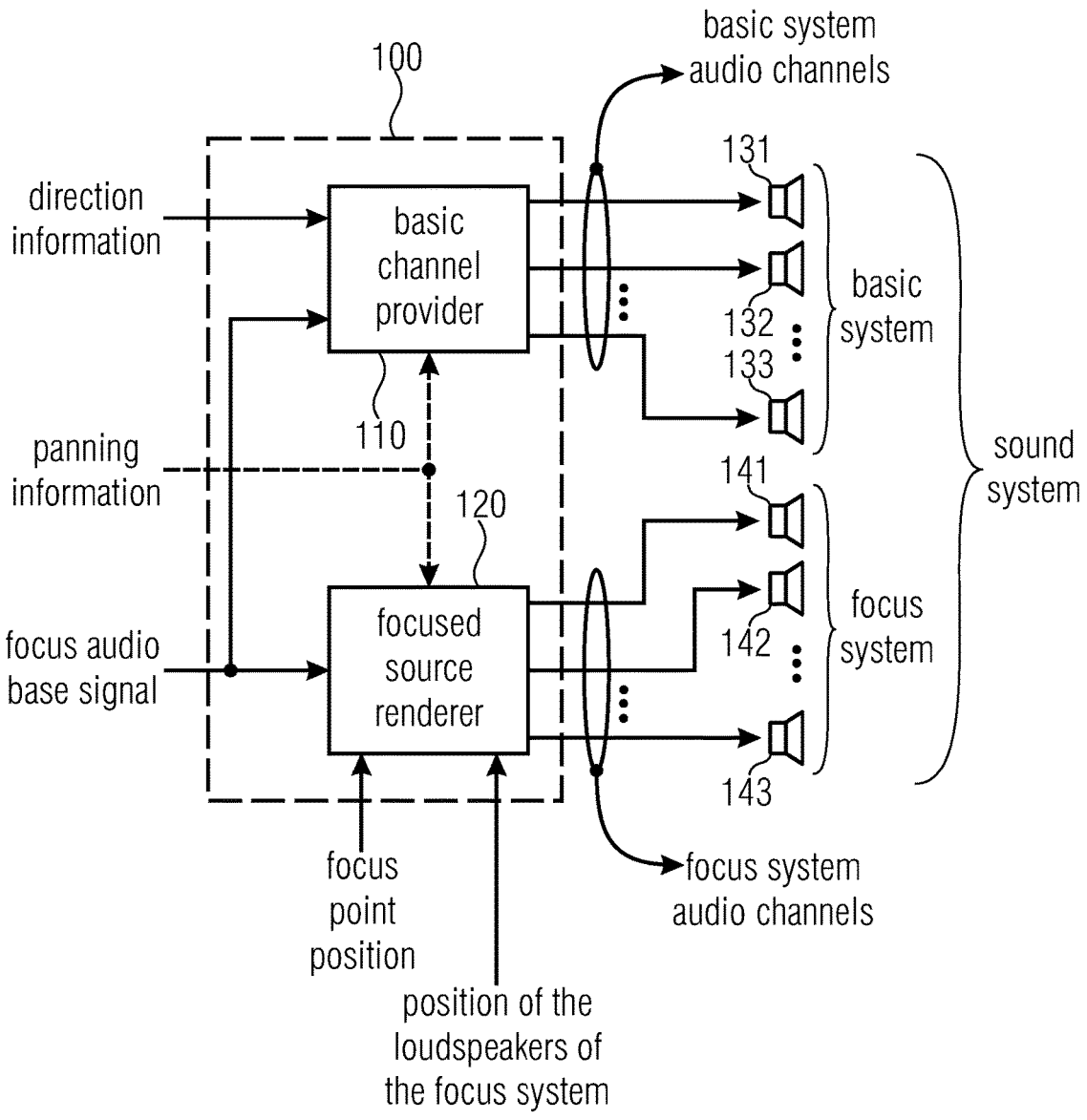

FIG. 1*e* illustrates an apparatus 100 for driving loudspeakers of a sound system according to such an embodiment, wherein the basic channel provider 110 and the focused source renderer 120 are configured to receive panning information. The panning information may, for example, comprise a panning factor describing the mixing ratio of the focus audio base signal between the basic channel provider 110 and the focused source renderer 120.

For example, a panning factor $\alpha$ of $\alpha=1.0$ may indicate that the auditory event is only reproduced by the focus system, but not by the basic system. Consequently, in case of a panning factor $\alpha$ of $\alpha=1.0$, the focused source renderer 120 will provide focus system audio channels which comprise sound portions which represent the auditory event. In case of a panning factor $\alpha$ of $\alpha=1.0$, the basic channel provider 110 will provide basic system audio channels which do not comprise sound portions which represent the auditory event.

Moreover, for example, a panning factor $\alpha$ of $\alpha=0$ may indicate that the auditory event is only reproduced by the basic system, but not by the focus system. Consequently, in case of a panning factor $\alpha$ of $\alpha=0$, the focused source renderer 120 will provide focus system audio channels which do not comprise sound portions which represent the auditory event. In case of a panning factor $\alpha$ of $\alpha=0$, the basic channel provider 110 will provide basic system audio channels which comprise sound portions which represent the auditory event.

Furthermore, for example, a panning factor $\alpha$ of $\alpha=0.5$ may indicate that the auditory event is reproduced by the basic system and also the focus system, but with a reduced sound level. Consequently, in case of a panning factor $\alpha$ of $\alpha=0.5$, the focused source renderer 120 will provide focus system audio channels which comprise sound portions which represent the auditory event, but with a reduced sound level (with a reduced sound energy) of the corresponding auditory event sound portions. In case of a panning factor $\alpha$ of $\alpha=0.5$, the basic channel provider 110 will also provide basic system audio channels which comprise sound portions which represent the auditory event, but also with a reduced sound level (with a reduced sound energy) of the corresponding auditory event sound portions.

Moreover, e.g. the panning factor may also have any other value, e.g. between 0 and 1.0, wherein the basic channel provider 110 may be configured to steer the sound level (or sound energy) of auditory event sound portions within the basic system audio channels depending on the panning factor, and/or wherein the focused source renderer 120 may be configured to steer the sound level (or sound energy) of auditory event sound portions within the focus system audio channels depending on the panning factor.

In an embodiment, the panning information might be used to generate gain factors for the basic channel provider and the focused source renderer according to a panning law.

In embodiments, the basic channel provider 110 is furthermore configured to receive direction information as meta data. The basic channel provider 110 may be configured to determine (e.g. calculate) the basic system audio channels based on the focus audio base signal and based on the direction information.

The basic channel provider 110 may be configured to distribute the focus audio base signal to the basic system audio channels such that a direction impression is preserved.

E.g. when the basic system is a surround system, for example, a focus audio base signal, which shall be located at a front-left position will mainly be panned by the basic channel provider 110 to the left channel of a surround system. A focus audio base signal, which shall have a position at a center-front position, will be panned by the basic channel provider 110 to the center channel of the surround system.

In an embodiment, the direction information may be determined based on the information on the position of the focus point. For example, the direction information may be determined by determining the direction of the focus point position relative to a position of a listener. In another embodiment, however, the direction information is provided independently from the provided information on the position of the focus point.

According to an embodiment, the focused source renderer 120 is adapted to generate the at least three focus group audio channels, so that the audio output produced by the focus system allows localizing the position of the focus point 150 by the listener in the environment, wherein the position of the focus point 150 is closer to a position of a sweet spot 160 in the environment than any other position of one of the loudspeakers 131, 132, 133, 134 of the basic system and closer to the position of the sweet spot 160 than any other position of one of the loudspeakers 141, 142, 143 of the focus system. FIG. 1*c* illustrates a scenario according to such an embodiment.

According to an embodiment, the focus system is a Wave Field Synthesis system. In such an embodiment, the Wave Field Synthesis system may comprise a plurality of more than 10, more than 20 or more than 50 loudspeakers, and the focused source renderer 120 is configured to provide the focus system audio channels to some or all of the loudspeakers of the Wave Field Synthesis system.

In another embodiment, the focus system employs Higher Order Ambisonics.

According to a further embodiment, the basic system is a 5.1 surround system. In such an embodiment, the basic system comprises the six loudspeakers of the 5.1 surround system, and the basic channel provider 110 is configured to provide the basic system audio channels to some or all of the loudspeakers of the 5.1 surround system.

Figure 5A:
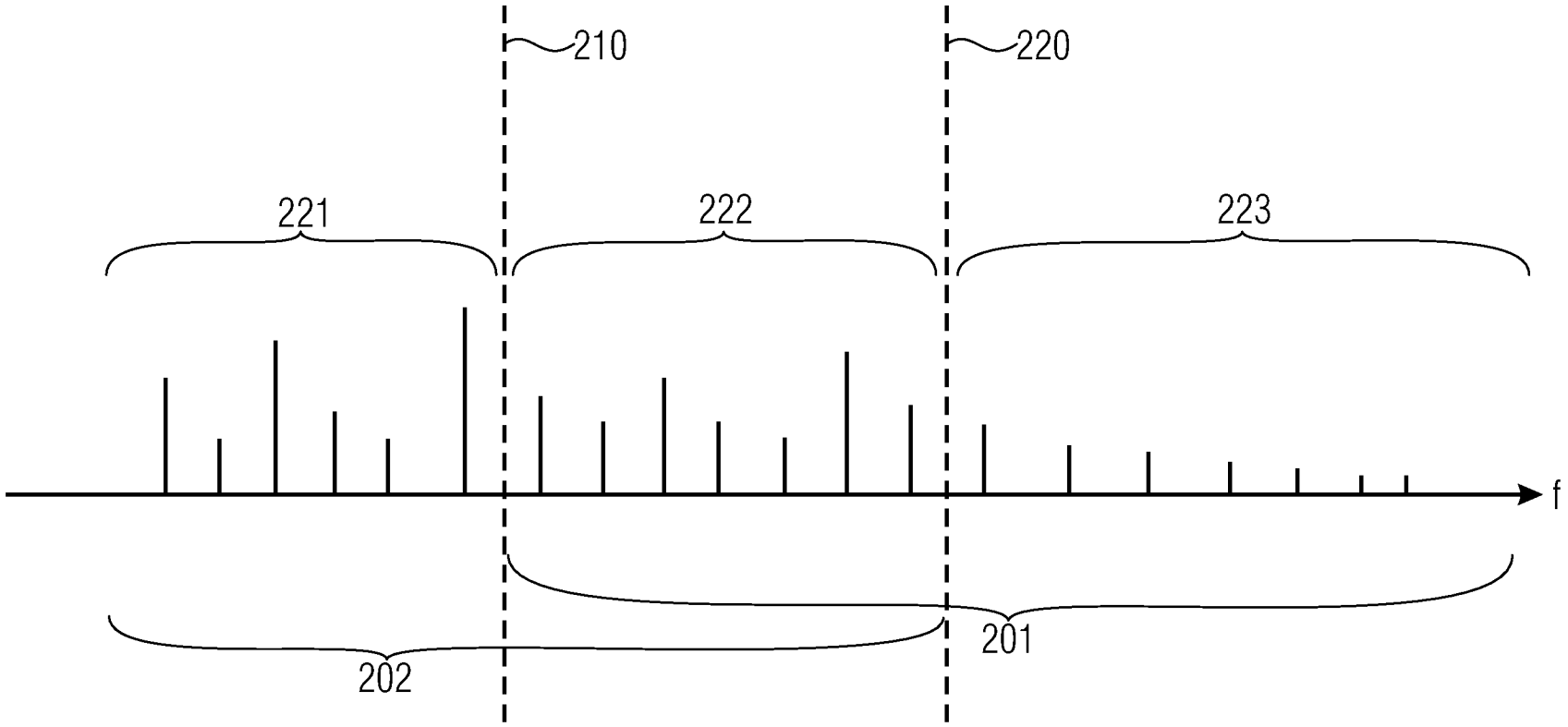
FIG. 5*a* illustrates a spectrum of an audio effect signal according to an embodiment.

FIG. 5*a* illustrates a spectrum of an audio effect signal according to an embodiment. The spectrum comprises the spectral values of the audio effect signal at different frequencies f.

According to an embodiment, the focus audio base signal only comprises first frequency portions 201 of the audio effect signal, wherein the first frequency portions 201 only have frequencies which are higher than a first predetermined frequency value 210, and wherein at least some of the first frequency portions 201 have frequencies which are higher than a second predetermined frequency value 220. The second predetermined frequency value 220 is higher than or equal to the first predetermined frequency value 210.

The focused source renderer 120 is configured to generate the at least three focus group audio channels based on the focus audio base signal such that the focus group audio channels only have frequencies which are higher than a predefined (=predetermined) frequency value (e.g. the first predetermined frequency value 210 may be the predefined frequency value).

The basic channel provider 110 is configured to generate the basic system audio channels based on the secondary effect signal.

Figure 5B:
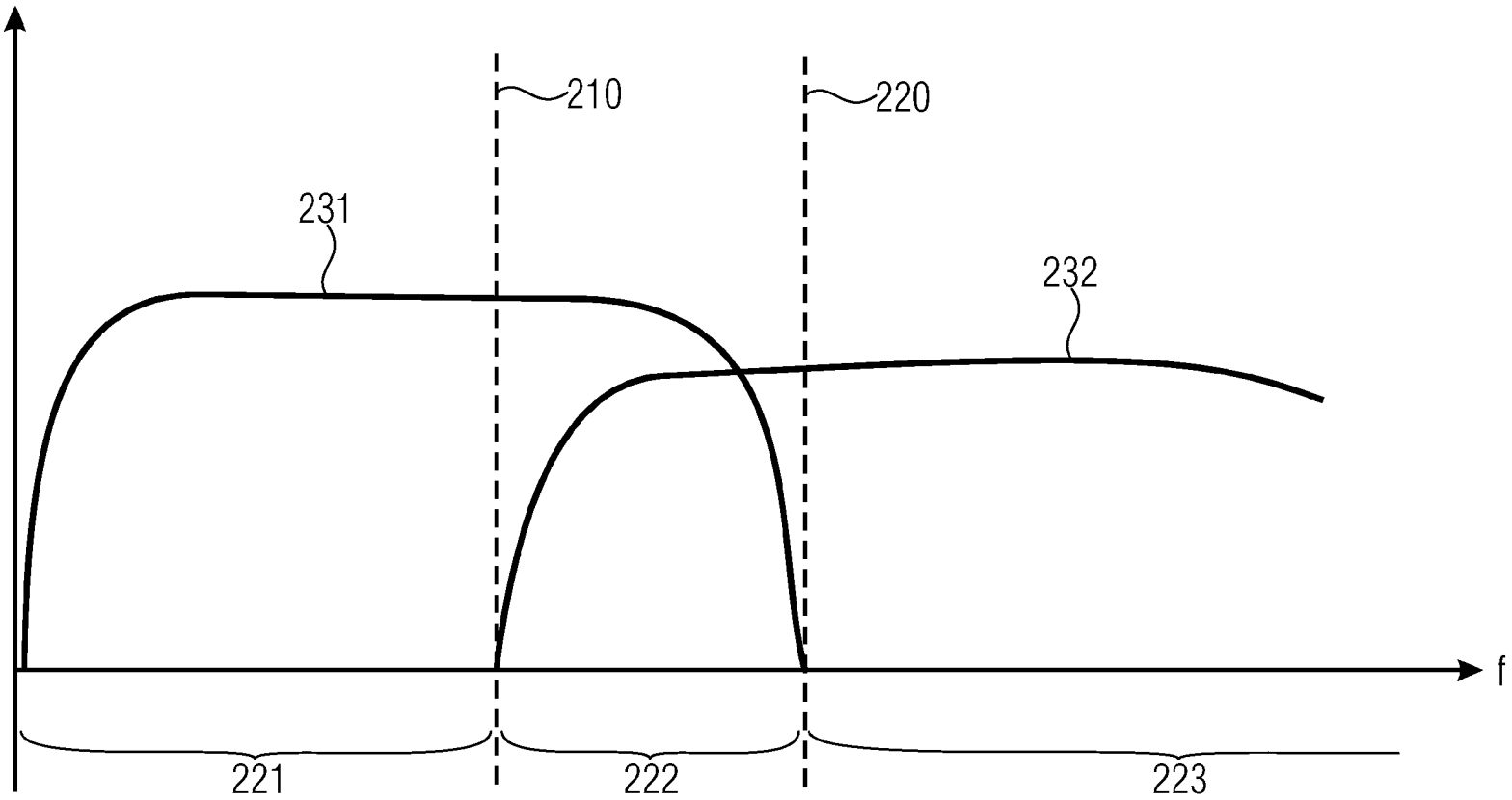
FIG. 5*b* illustrates spectral representations of the secondary effect signal and of the focus audio base signal according to an embodiment.

In a particular embodiment illustrated by FIG. 5*b*, the secondary effect signal only comprises second frequency portions 202 of the audio effect signal. The second frequency portions 202 only have frequencies which are lower than or equal to the second predetermined frequency value 220. At least some of the second frequency portions 202 have frequencies which are lower than or equal to the first predetermined frequency value 210.

In other words, in such an embodiment, the frequency portions of a first frequency range 221 of the audio effect signal may e.g. only be comprised by the secondary effect signal for the basic system. The frequency portions of a second frequency range 223 may e.g. only be comprised by the focus audio base signal (and by the focus group audio channels) for the focus system. Moreover, in some embodiments, there may be an intermediate frequency range 222, such that the frequency portions of the intermediate frequency range 222 between the first predetermined frequency value 210 and the second predetermined frequency value 220 are comprised by both the secondary effect signal for the basic system and the focus audio base signal (and the focus group audio channels) for the focus system. However, in another embodiment, not illustrated by FIG. 5*a*, the second predetermined frequency value 220 is equal to the first predetermined frequency value 210, and in such an embodiment, the intermediate frequency range 222 does not exist.

In particular, FIG. 5*b* illustrates a spectral representation 231 of the secondary effect signal and a spectral representation 232 of the focus audio base signal according to an embodiment. In a first frequency range 221, only the secondary effect signal has frequency components 231. In a second frequency range 223, only the focus audio base signal has frequency components 232. Moreover, in the scenario of FIG. 5*b*, there exists an intermediate frequency range 222, where both the secondary effect signal for the basic system as well as the focus audio base signal for the focus system have frequency components 231, 232. The secondary effect signal 231 and the focus audio base signal 232 may be generated by a filter unit 510 by filtering the audio effect signal, e.g. by employing a low-pass filter and a high-pass filter, respectively.

Figure 5C:
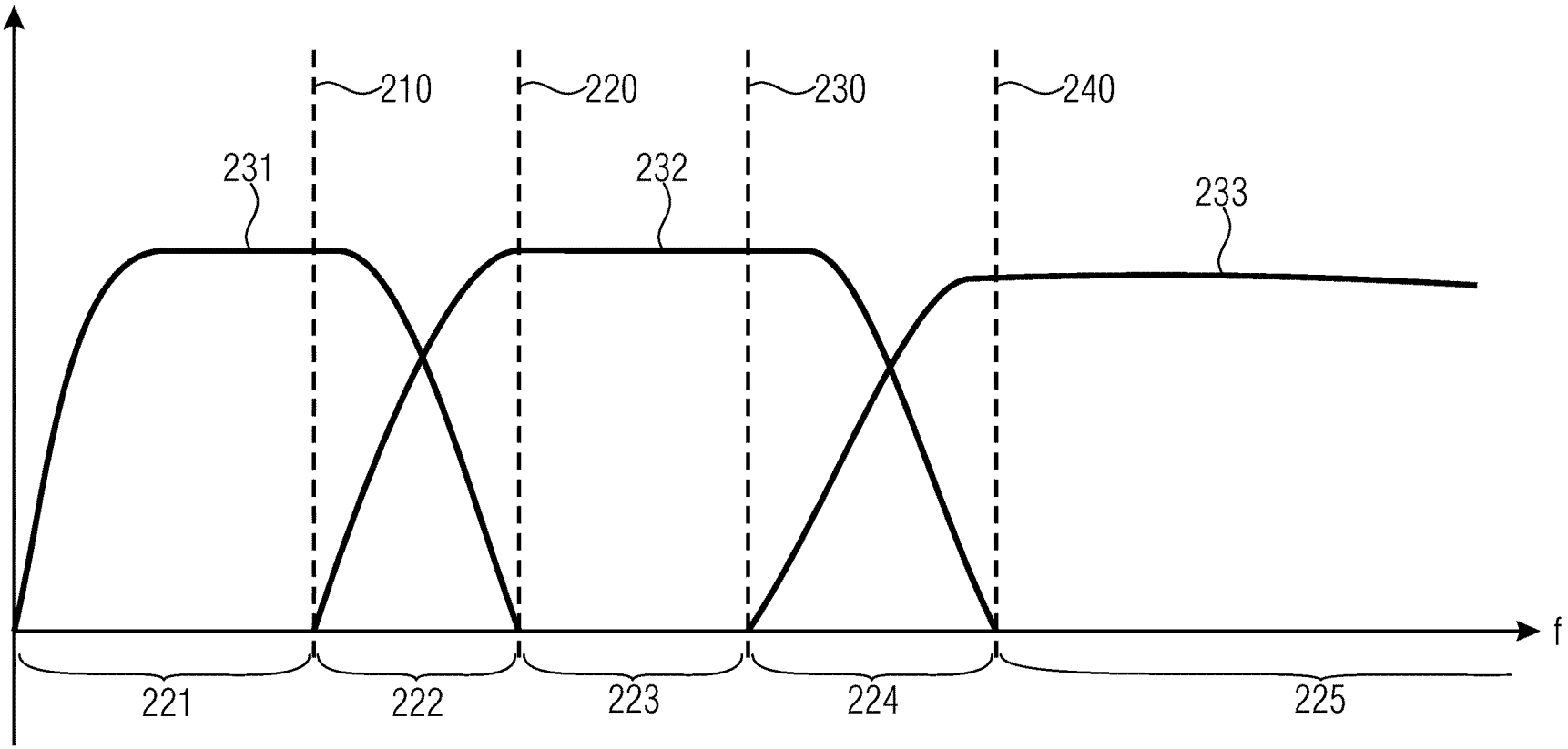
FIG. 5*c* illustrates spectral representations of the secondary effect signal 231 and of the focus audio base signal 232 according to another embodiment.

In another particular embodiment illustrated by FIG. 5*c*, the basic channel provider 110 is configured to generate the basic system audio channels based on a secondary effect signal, wherein the secondary effect signal only comprises second frequency portions of the audio effect signal, wherein the second frequency portions only have frequencies which are either lower than or equal to the second predetermined frequency value 220, or which are higher than a third predetermined frequency value 230. In such an embodiment, the first frequency portions only have frequencies which are lower than a fourth predetermined frequency value 240. The fourth predetermined frequency value 240 is higher than or equal to the third predetermined frequency value 230. The third predetermined frequency value 230 is higher than the second predetermined frequency value (220).

In particular, FIG. 5*c* illustrates a spectral representation 231, 233 of the secondary effect signal and a spectral representation of the focus audio base signal 232 according to another embodiment. In a first frequency range 221, only the secondary effect signal has frequency components 231. In a second frequency range 223, only the focus audio base signal has frequency components 232. In a further, third frequency range 225, only the secondary effect signal has frequency components 233. Moreover, in the scenario of FIG. 5*c*, there exists a first intermediate frequency range 222, where both the secondary effect signal for the basic system as well as the focus audio base signal for the focus system have frequency components 231, 232. Furthermore, there exists a second intermediate frequency range 224, where both the secondary effect signal for the basic system as well as the focus audio base signal for the focus system have frequency components 232, 233. The secondary effect signal and the focus audio base signal may be generated by a filter unit 510 by filtering the audio effect signal, e.g. by employing a band-pass filter.

Figure 1F:
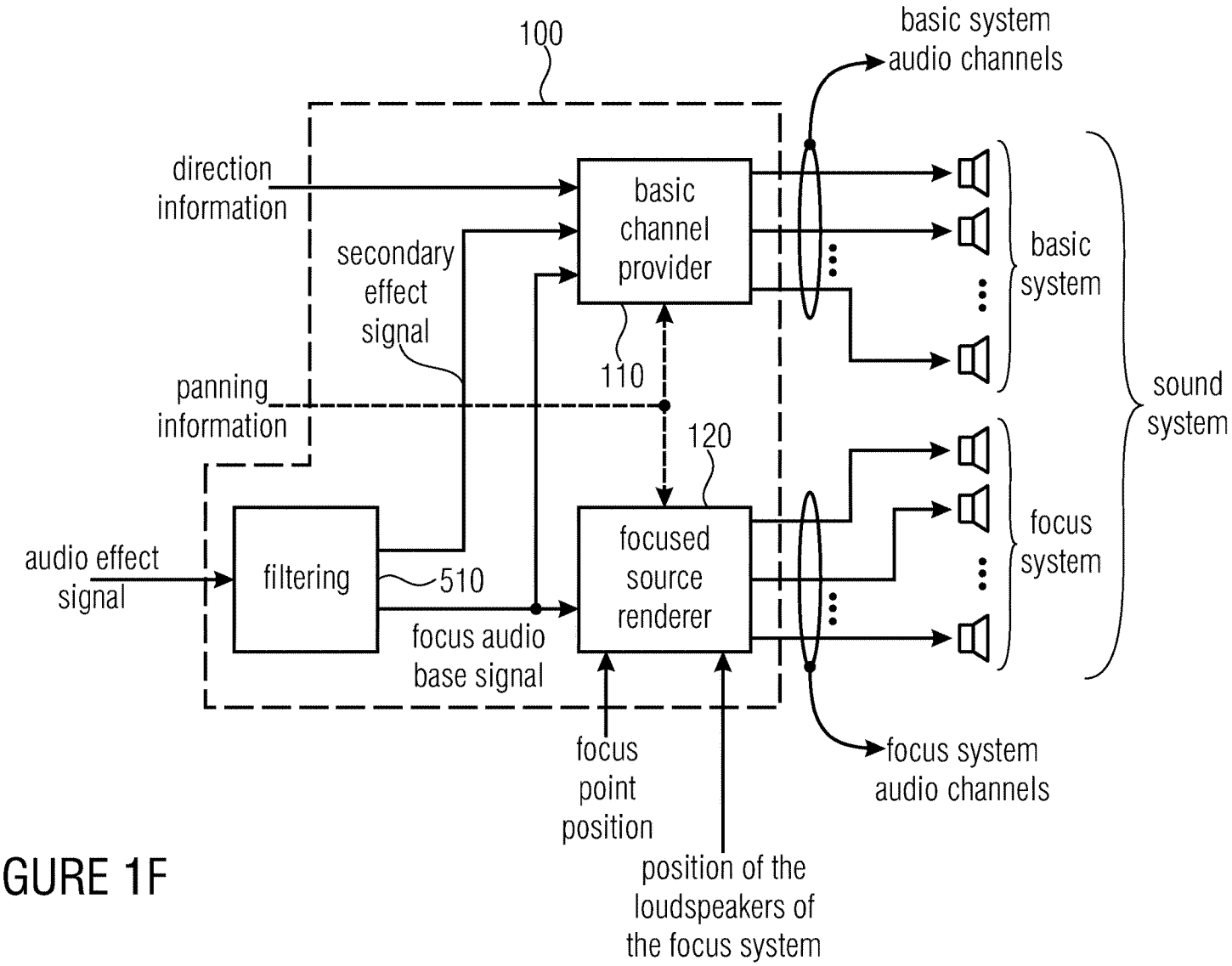

FIG. 1*f* illustrates an apparatus 100 for driving loudspeakers of a basic system, wherein the apparatus comprises a filter unit 510, which is configured to receive an audio effect signal.

The filter unit 510 is configured to filter the audio effect signal to obtain a secondary effect signal and a focus audio base signal. E.g., the filter unit 510 is configured to filter the audio effect signal to obtain the secondary effect signal and the focus audio base signal such that the focus audio base signal is different from the audio effect signal. For example, the filter unit 510 may be configured to filter the audio effect signal such that the focus audio base signal only comprises first frequency portions of the audio effect signal and such that the secondary effect signal only comprises second frequency portions of the audio effect signal. For example, at least some of the second frequency portions may relate to frequencies which are different from the frequencies the first frequency portions relate to.

The filter unit 510 is configured to provide the secondary effect signal only to the basic channel provider 110, but not to the focused source renderer 120.

Moreover, in the embodiment of FIG. 1*f*, the filter unit 510 is configured to provide the focus audio base signal to the focused source renderer 120 and to the basic channel provider 110.

Furthermore, in the embodiment illustrated by FIG. 1*f*, the basic channel provider 110 and the focused source renderer 120 receive panning information, e.g. a panning factor $\alpha$.

The focused source renderer 120 is configured to generate the at least three focus group audio channels based on the focus audio base signal and based on the panning information for blending the focus audio base signal between the basic system and the focus system. For example, a panning factor $\alpha=0.5$ may mean, that the focus audio base signal is reproduced by the focus system, but with a reduced sound level.

The basic channel provider 110 is configured to generate the basic system audio channels based on the focus audio base signal and based on the panning information for blending the focus audio base signal between the basic system and the focus system. For example, a panning factor $\alpha=0.5$ may mean, that the focus audio base signal is reproduced by the basic system, but with a reduced sound level.

Moreover, the basic channel provider 110 is configured to generate the basic system audio channels also based on the secondary effect signal. For example, the basic channel provider 110 may be configured to modify the focus audio base signal such that the sound level of the focus audio base signal is reduced depending on the panning factor $\alpha$ to obtain a modified focus audio base signal. The basic channel provider 110 may moreover be configured to mix the modified focus audio base signal and the secondary effect signal to generate the basic system audio channels.

Figure 1G:
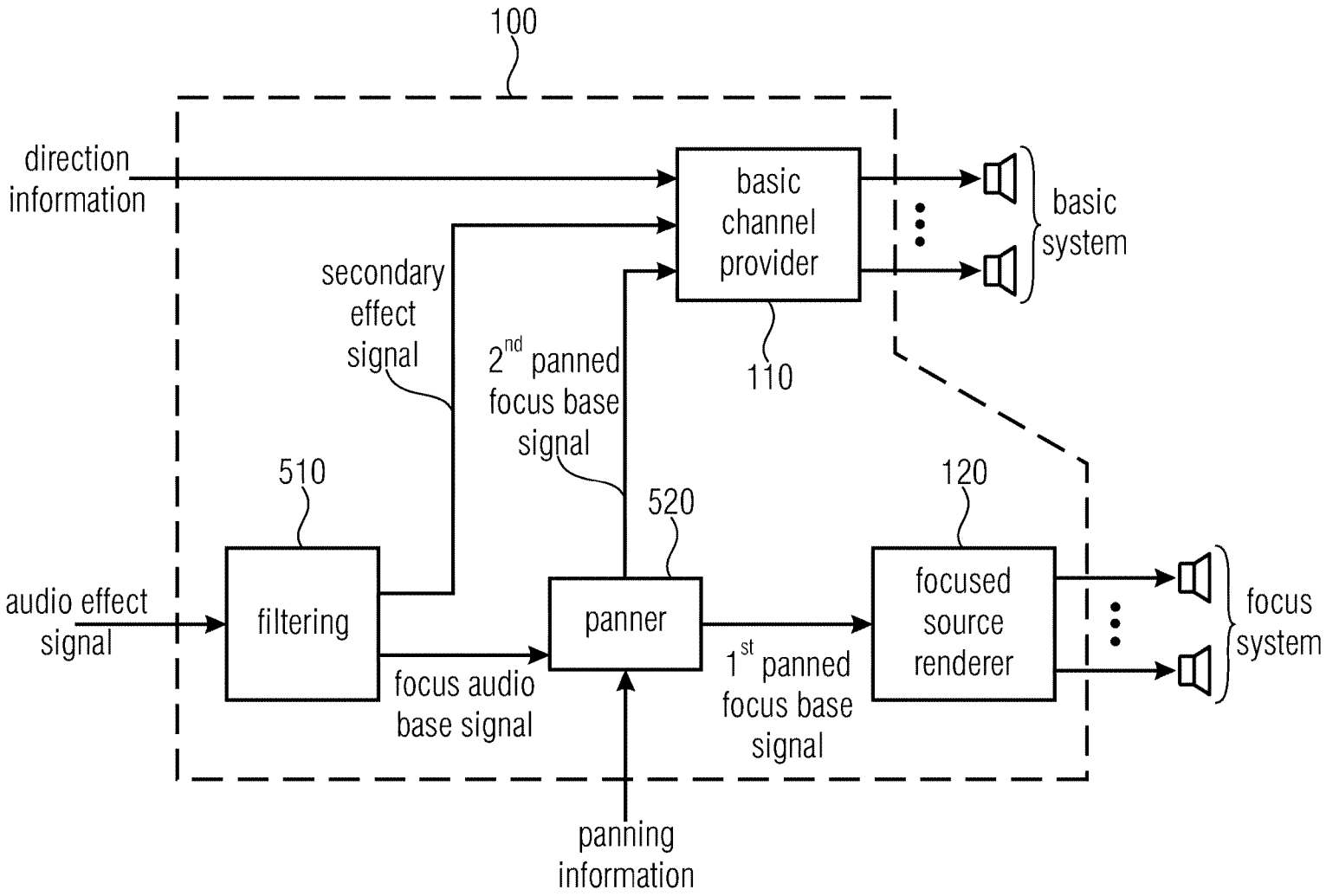

FIG. 1*g* illustrates an apparatus 100 for driving loudspeakers of a basic system, wherein the apparatus comprises a filter unit 510, which is configured to receive an audio effect signal and a panner 520. The filter unit 510 is moreover configured to filter the audio effect signal to obtain a secondary effect signal and the focus audio base signal, such that the focus audio base signal is different from the audio effect signal. Furthermore, the panner 520 is configured to generate a first panned focus base signal and a second panned focus base signal by modifying the focus audio base signal depending on panning information. The focused source renderer 120 is configured to provide the focus system audio channels for the focus system based on the first panned focus base signal. The basic channel provider 110 is configured to provide the basic system audio channels for the basic system based on the secondary effect signal and based on the second panned focus base signal.

E.g., the embodiment illustrated by FIG. 1*g* is similar to the embodiment of FIG. 1*f*, but differs from the embodiment of FIG. 1*f* in that the filter unit 510 is configured to feed the focus audio base signal into the panner 520.

For example, the panner 520 is configured to generate a first panned focus base signal and a second panned focus base signal based on the focus audio base signal and based on panning information, e.g. a panning factor $\alpha$. For example, a panning factor $\alpha=0.5$ may mean that the sound level of the focus audio base signal is reduced by the panner 520 to obtain the first panned focus base signal. Moreover, a panning factor $\alpha=0.5$ may mean that the sound level of the focus audio base signal is also reduced by the panner 520 to obtain the second panned focus base signal. A panning factor $\alpha$ of $0.5<\alpha<1.0$ may mean, that the panner 520 generates the first panned focus base signal and the second panned focus base signal such that the average sound level of the first panned focus base signal is greater than the average sound level of second panned focus base signal. A panning factor $\alpha$ of $0<\alpha<0.5$ may mean, that the panner 520 generates the first panned focus base signal and the second panned focus base signal such that the average sound level of the first panned focus base signal is smaller than the average sound level of second panned focus base signal.

The panner 520 is, e.g., configured to feed the first panned focus base signal into the focused source renderer 120 and is moreover configured to feed the second panned focus base signal into the basic channel provider 110.

The focused source renderer 120 is configured to generate the at least three focus group audio channels based on the first panned focus base signal.

The basic channel provider 110 is, e.g., configured to generate the basic system audio channels based on the second panned focus base signal and based on the secondary effect signal. For example, the basic channel provider 110 may be configured to mix the second panned focus base signal and the secondary effect signal to generate the basic system audio channels.

In some embodiments, the basic channel provider 110 of FIG. 1*g* is furthermore configured to receive direction information as meta data. The basic channel provider 110 of FIG. 1*g* may use the direction information to determine (e.g. calculate) the basic system audio channels based on the second panned focus base signal (e.g., as described with reference to FIG. 1*e* for the focus audio base signal of FIG. 1*e*) and based on the secondary effect signal.

According to some embodiments, more than one focus point exists (e.g. a first and one or more further focus points) and different focus sounds (e.g. different focus audio base signals) are assigned to different focus points. In such embodiments, the focused source renderer 120 is configured to calculate a further plurality of further delay values for the loudspeakers 141, 142, 143 of the focus system based on the positions of the loudspeakers 141, 142, 143 of the focus system and based on a further position of a further focus point. The focused source renderer 120 is configured to generate at least three further focus group audio channels for at least some of the loudspeakers 141, 142, 143 of the focus system based on the plurality of further delay values and based on a further focus audio base signal to provide the focus system audio channels. For example, the at least three further focus group audio channels being assigned to the further focus point may be mixed with the at least three focus group audio channels relating to the first focus point to obtain the focus system audio channels. E.g. each of the at least three further focus group audio channels being assigned to the further focus point may be added to the respective one of the at least three focus group audio channels relating to the first focus point to obtain the focus system audio channels.

In some embodiments, audio object coding is employed, e.g. Spatial Audio Object Coding (SAOC), and each audio object may relate to a different focus point and a different focus audio base signal.

In some embodiments, the apparatus 100 is configured to receive a position of a listener from at least one tracking unit (not shown). E.g. the at least one tracking unit is arranged for determining the position of the listener. The apparatus 100 is adapted to shift the focus point 150 depending on the position of the listener. In a particular embodiment, the at least one tracking unit is a head tracker unit arranged for determining the head position of the listener. Moreover, according to an embodiment, a system is provided comprising such an apparatus and at least one tracking unit.

In an exemplary embodiment, at least one head tracker unit is arranged for determining a head position of the listener, wherein the apparatus is adapted to shift the focus point depending on the head position. This allows for keeping the sound focused to the listener regardless of his height, seating position and/or movement within the environment. The head tracker may comprise at least one camera.

In some embodiments, the tracking unit, e.g. the head tracker unit, (not shown) may be configured to determine a head position. E.g. when the apparatus is employed in a vehicle, the head tracker unit may be configured to determine head positions of the vehicle's occupants. The tracking unit, e.g. the head tracker unit, may feed the head position directly into the focused source renderer 120, so that the focus points are determined by the focused source renderer 120 depending on the head position. In other embodiments, the head tracker unit may feed the head position to a control unit, e.g. a board computer (not shown) so that the focus points are determined by this control unit and then forwarded to the focused source renderer. The apparatus is adapted to shift the focus point depending on the head position acquired by the tracking unit, e.g. by the head tracker unit.

Figure 6A:
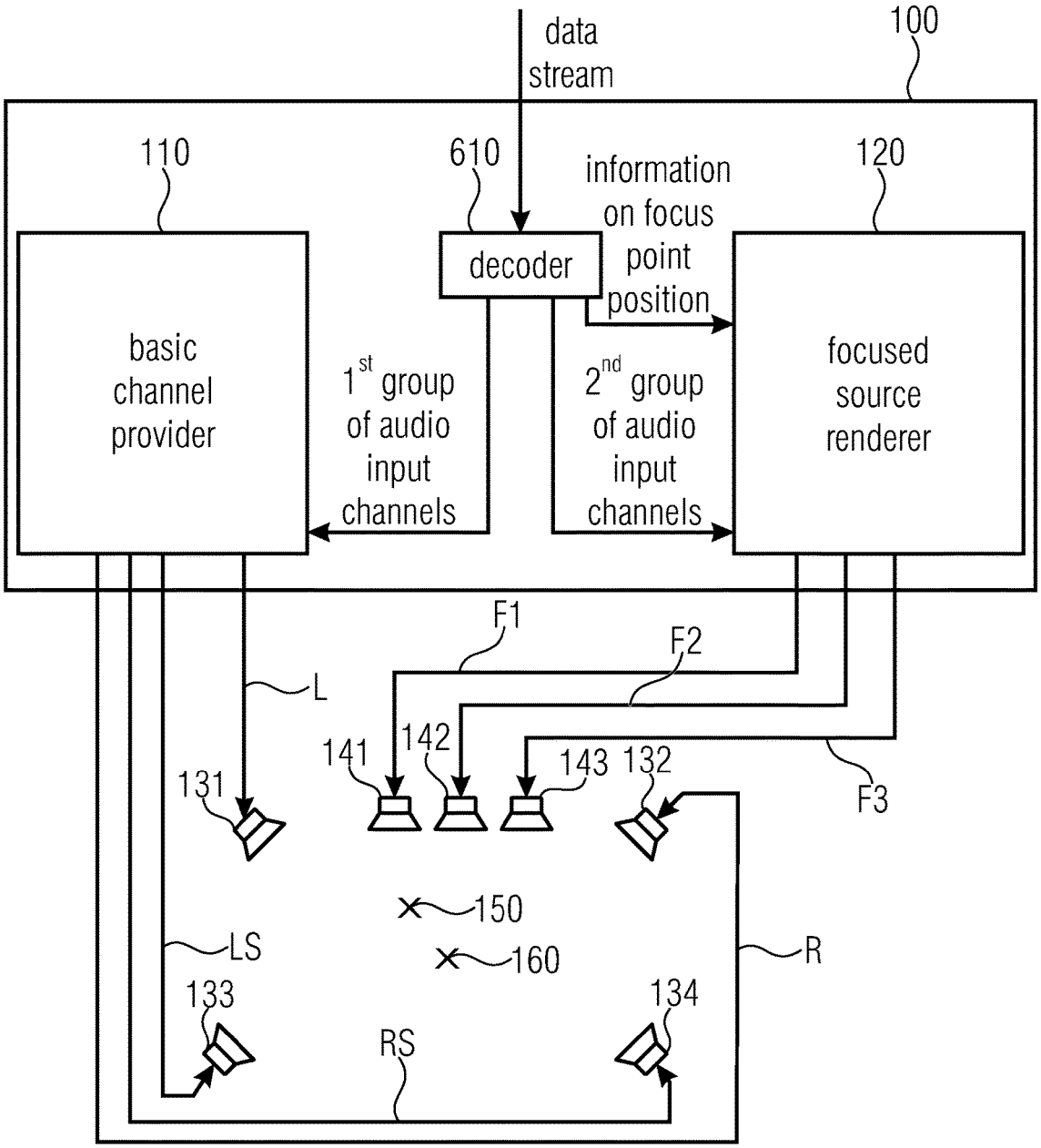
FIG. 6*a* illustrates an apparatus for driving loudspeakers of a sound system according to an embodiment, wherein the apparatus furthermore comprises a decoder.

FIG. 6*a* illustrates an apparatus for driving loudspeakers of a sound system according to an embodiment, wherein the apparatus furthermore comprises a decoder 610 being configured to decode a data stream to obtain a first group of one or more audio input channels, a second group of one or more audio input channels and meta-data comprising information on the position of the focus point, wherein the information on the position of the focus point 150 is relative to a position of a listener. The decoder 610 is arranged to feed the first group of audio input channels into the basic channel provider 110. The basic channel provider 110 is configured to provide the basic system audio channels to the loudspeakers based on the first group of audio input channels. Moreover, the decoder 610 is arranged to feed the second group of audio input channels and the information on the position of the focus point into the focused source renderer 120, and the focused source renderer 120 is configured to generate the at least three focus group audio channels based on the focus audio base signal, wherein the focus audio base signal depends on one or more audio input channels of the second group of audio input channels.

Figure 6B:
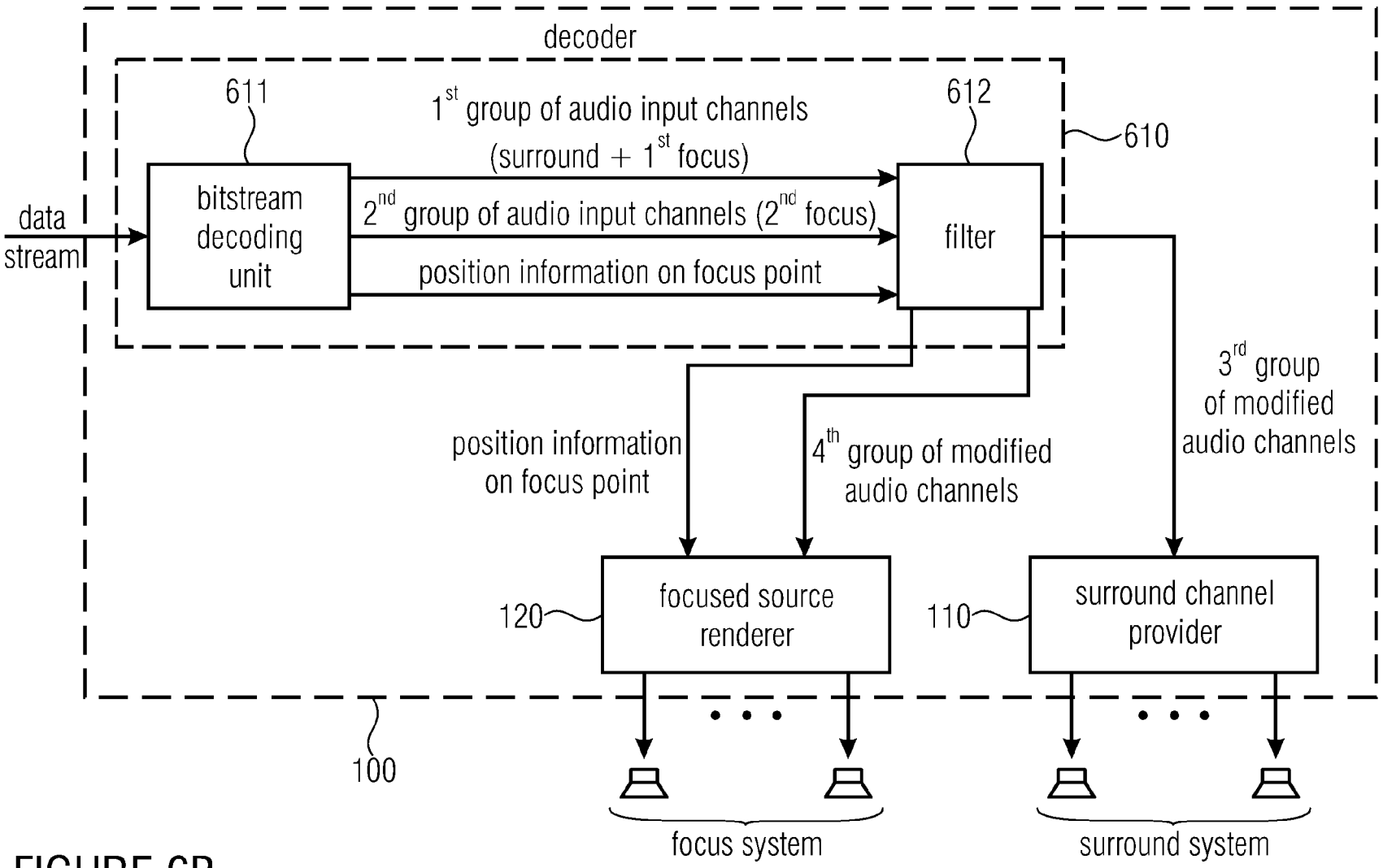
FIG. 6*b* illustrates an apparatus for driving loudspeakers of a sound system, wherein the apparatus furthermore comprises a decoder, according to another embodiment.

In another embodiment illustrated by FIG. 6*b*, the basic system may, for example, be a surround system and the basic channel provider may, for example, be a surround channel provider 110. The decoder 610 is configured to decode a data stream to obtain a first group of one or more audio input channels, a second group of one or more audio input channels and meta-data comprising information on the position of one or more focus points. The information on the position of each of the focus points 150 is relative to a position of a listener. Each of the audio input channels of the first group of audio input channels comprises basic channel information and first focus information, wherein each of the audio input channels of the second group of audio input channels comprises second focus information. The basic channel information may, for example, be surround channel information, as illustrated by FIG. 6*b*.

E.g. by employing a filter 612, the decoder 610 is configured to generate a third group of one or more modified audio channels based on the basic channel information (e.g. surround channel information) of the first group of the audio input channels, the second group of audio input channels and the information on the position of the focus points. The decoder 610 is arranged to feed the third group of modified audio channels into the basic channel provider 110 being a surround channel provider. The surround channel provider 110 is configured to provide the basic system audio channels to the loudspeakers based on the third group of modified audio channels.

Moreover, e.g. by employing the filter 612, the decoder 610 is configured to generate a fourth group of modified audio channels based on the first focus information of the first group of audio input channels and based on the second focus information of the second group of audio input channels. Furthermore, the decoder 610 is arranged to feed the fourth group of modified audio channels and the information on the position of the focus point into the focused source renderer 120. The focused source renderer 120 is configured to generate the at least three focus group audio channels based on the focus audio base signal, wherein the focus audio base signal depends on one or more modified audio channels of the fourth group of modified audio channels.

FIG. 6*b* illustrates an apparatus 100 for driving loudspeakers of a sound system. In the embodiment illustrated by FIG. 6*b*, the decoder 610 may, for example, comprise a bitstream decoding unit 611 for decoding the data stream to obtain the first group of one or more audio input channels, the second group of one or more audio input channels and the meta-data comprising the information on the positions of the focus points. The filter 612 may, for example, separate the basic channel information (e.g. surround channel information) from the first focus information of the first group of audio input channels depending on the second group of audio input channels and the positions of the focus points.

Figure 6C:
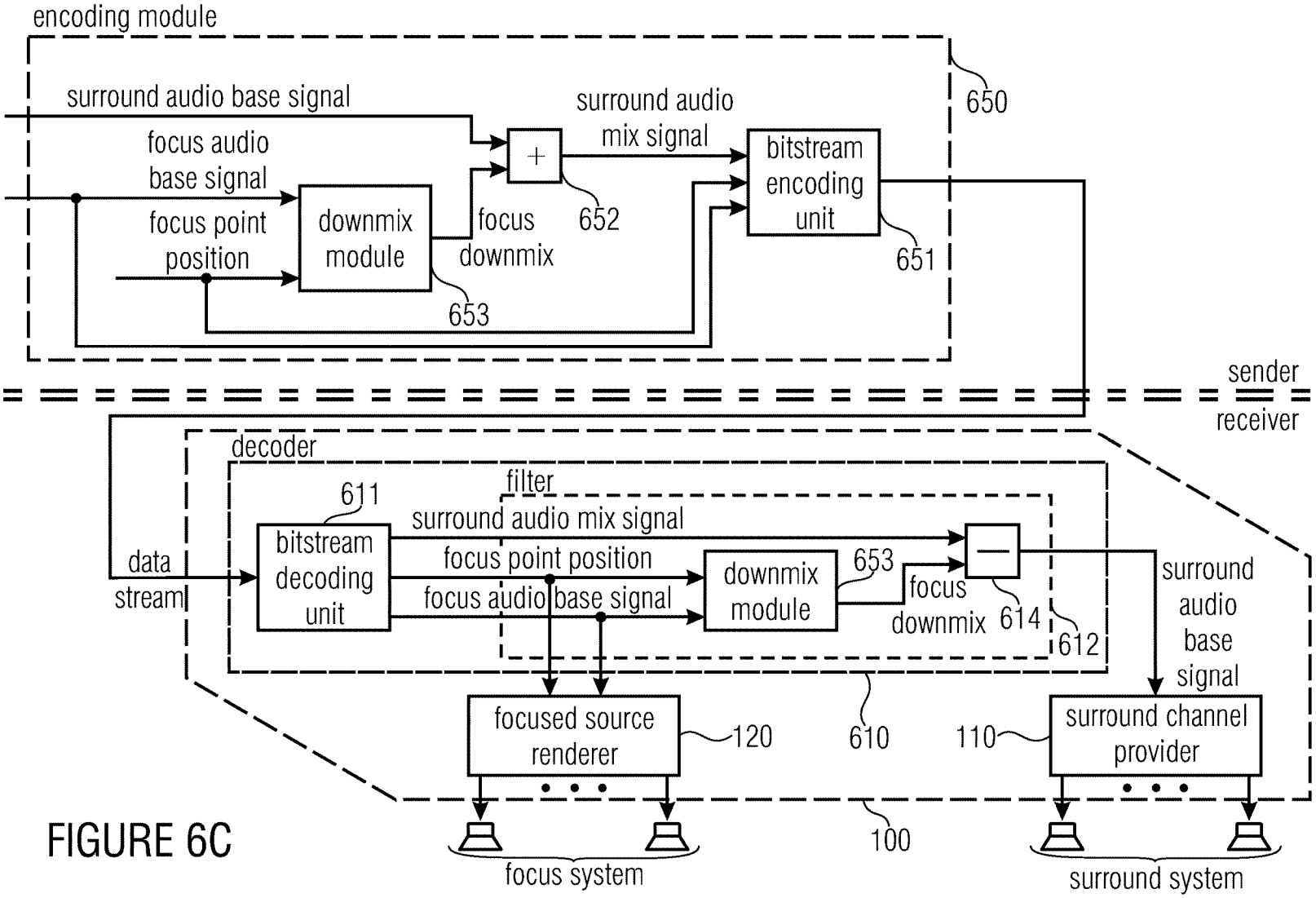
FIG. 6*c* illustrates an apparatus for driving loudspeakers of a sound system located at a receiver side, and an encoding module at a sender side.

FIG. 6*c* illustrates an apparatus 100 for driving loudspeakers of a sound system located at a receiver side, and an encoding module 650 at a sender side. In FIG. 6*c*, the basic channel provider 120 of the apparatus 100 for driving loudspeakers of a sound system is a surround channel provider. The apparatus 100 and the encoding module 650 form a system.

The encoding module 650 comprises a downmix module 653, a mixer 652 and a bitstream encoding unit 651.

At the sender side, a basic audio base signal, e.g. a surround audio base signal, is fed into the mixer 652. The surround audio base signal may, for example, comprise 5 channels of a surround signal or may, for example comprise 6 channels of a 5.1 surround signal. The surround audio base signal may, for example, be an ordinary surround signal which may be played back by a surround system.

Moreover, a focus downmix is also fed into the mixer 652. The focus downmix may have the same number of channels as the surround audio base signal. The mixer 652 mixes the surround audio base signal and the focus downmix to obtain a basic audio mix signal, e.g. a surround audio mix signal. When no decoder 610 (and no focus system) exists on a receiver side, the surround audio mix signal comprising e.g. five or six channels, which represent the mix of the surround audio base signal and the focus downmix, are played back by the surround system. By this, the surround system is used to play back the focus sound, when no decoder 610 and no focus system is present at a receiver side.

The focus downmix may be generated by the downmix module 653 on the sender side. The downmix module 653 receives a position of a focus point and a focus audio base signal. The downmix module 653 generates from the focus audio base signal a plurality of channels of the focus downmix, wherein the number of channels of the focus downmix is equal to the number of channels of the surround audio base signal. Each of the channels of the focus downmix represents a signal portion of the focus audio base signal that shall be played back by the respective loudspeaker of the surround system, if no decoder 610 and no focus system is present on a receiver side.

The bitstream encoding unit 651 receives the basic audio mix signal, e.g. the surround audio mix signal. Moreover, the bitstream encoding unit 651 also receives the focus audio base signal and the position of the focus point. The bitstream encoding unit 651 is configured to encode the basic audio mix signal (e.g. the surround audio mix signal), the focus audio base signal and the position of the focus point (the focus point position). The encoded surround audio mix signal, focus audio base signal and focus point position are then transmitted as a data stream from the sender side to the apparatus 100 for driving loudspeakers of a sound system located at the receiver side.

The apparatus 100 for driving loudspeakers of a sound system e.g. comprises a surround channel provider 110 as a basic channel provider, a focused source renderer 120 and a decoder 610. The decoder 610 comprises a bitstream decoding unit 611 and a filter 612. The filter comprises a downmix module 613 and a subtractor 614.

The bitstream decoding unit 611 receives the transmitted data stream and decodes the data stream to obtain the focus audio base signal, the position of the focus point (the focus point position), and the basic audio mix signal, e.g. the surround audio mix signal.

The focus audio base signal and the position of the focus point are then fed into the focused source renderer 120 to obtain the focus system audio channels of the focus system.

Moreover, the focus audio base signal and the focus point position are also fed into the downmix module 613. The downmix module 613 generates a focus downmix comprising a plurality of channels from the focus audio base signal and the position of the focus point in the same way as the downmix module 653 did on the sender side. By this, the downmix module 613 of the filter 612 generates the same focus downmix as the downmix module 653 on the sender side.

The focus downmix is then fed into the subtractor 614. Moreover, the basic audio mix signal, e.g. the surround audio mix signal, is also fed into the subtractor 614. The subtractor 614 is configured to subtract the focus downmix from the basic audio mix signal, e.g. the surround audio mix signal, e.g. each respective channel of the focus downmix is subtracted from the corresponding channel of the basic audio mix signal, e.g. the surround audio mix signal. By this, the portions of the basic audio mix signal (e.g. the surround audio mix signal) that relate to the focus audio base signal are removed from the basic audio mix signal (e.g. the surround audio mix signal), and the original basic audio base signal (e.g. the original surround audio base signal) is obtained. The basic audio base signal (e.g. the surround audio base signal) is then fed into the basic channel provider (e.g. the surround channel provider) 110, e.g. to steer the loudspeakers of the basic system, e.g. the surround system.

According to some embodiments, the decoder 610, for example, the decoder 610 of the embodiment of FIG. 6*a*, FIG. 6*b* or FIG. 6*c*, is configured to decode the data stream to obtain six channels of an HDMI audio signal as the first group of audio input channels. Moreover, the decoder 610 is configured to decode the data stream to obtain two further channels of the HDMI audio signal as the second group of audio input channels.

According to some embodiments, the decoder 610, e.g., the decoder 610 of the embodiment of FIG. 6*a*, FIG. 6*b* or FIG. 6*c*, is configured to decode the data stream to obtain six channels of a 5.1 surround signal as the first group of audio input channels. Moreover, the decoder 610 is arranged to feed the six channels of the 5.1 surround signal into the basic channel provider. Furthermore, the basic channel provider 110 is configured to provide the six channels of the 5.1 surround signal to drive the loudspeakers of the basic system being a surround system.

According to some embodiments, the decoder 610, for example, the decoder 610 of the embodiment of FIG. 6*a*, FIG. 6*b* or FIG. 6*c*, is configured to decode the data stream to obtain a plurality of spatial audio object channels of a plurality of encoded spatial audio objects (regarding encoded spatial audio objects, see [7]). Moreover, the decoder 610 is configured to decode at least one object position information for at least one of the spatial audio object channels. Furthermore, the decoder 610 is arranged to feed the plurality of the spatial audio object channels and the at least one object position information into the focused source renderer 120. Moreover, the focused source renderer 120 is configured to calculate the plurality of delay values for the loudspeakers of the focus system based on the positions of the loudspeakers of the focus system and based on one of the at least one object position information representing information on the position of the focus point. Furthermore, the focused source renderer 120 is configured to generate the at least three focus group audio channels for at least some of the loudspeakers of the focus system based on the focus audio base signal, wherein the focus audio base signal depends on one or more of the plurality of the spatial audio object channels.

Figure 7:
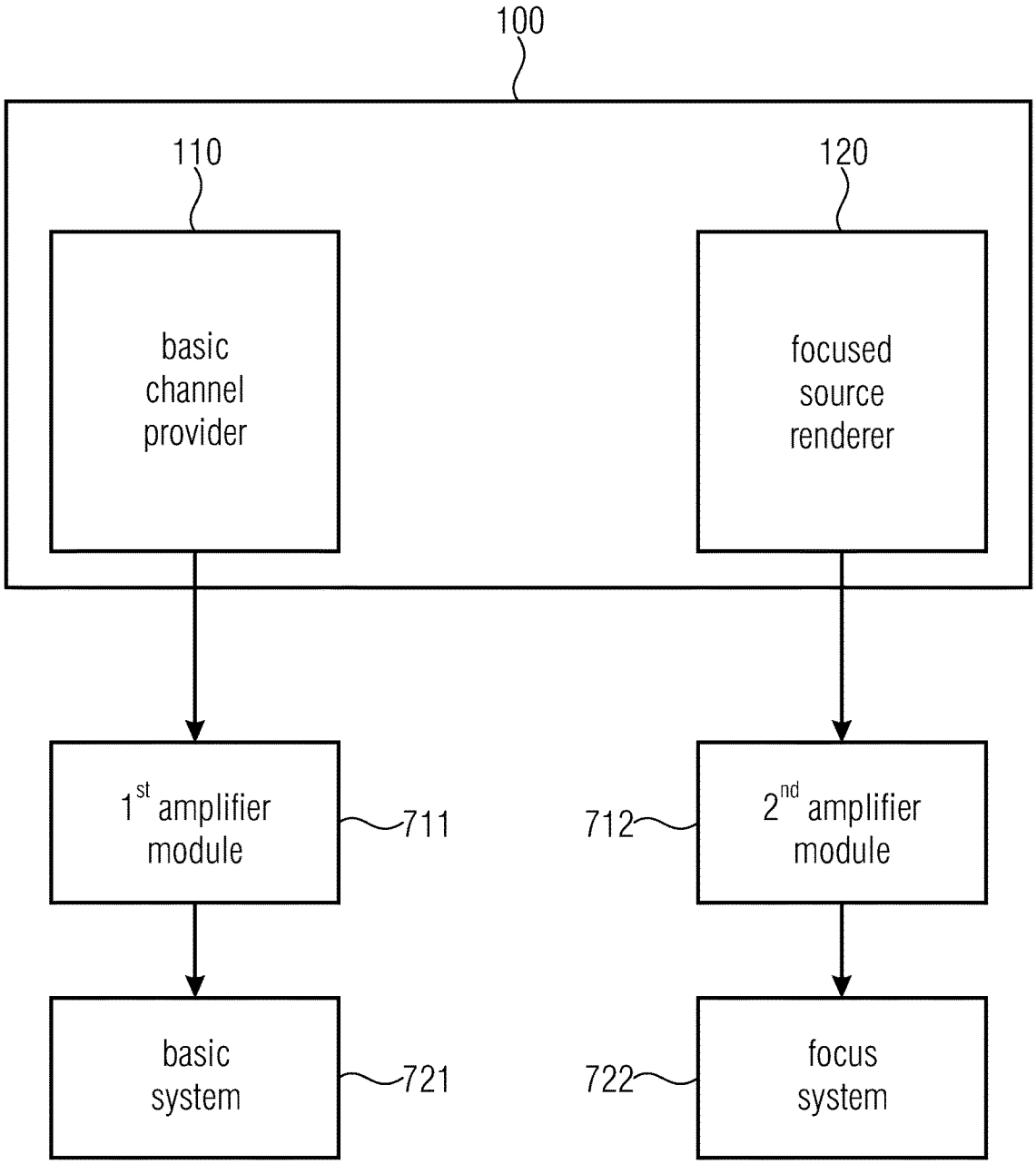
FIG. 7 illustrates a sound system according to an embodiment.

FIG. 7 illustrates a sound system according to an embodiment. The sound system comprises a basic system 721 comprising at least four loudspeakers, a focus system 722 comprising at least three further loudspeakers, a first amplifier module 711, a second amplifier module 712, and an apparatus 100 for driving loudspeakers of a sound system according to one of the above-described embodiments.

The first amplifier module 711 is arranged to receive the basic system audio channels provided by the basic channel provider 110 of the apparatus 100 for driving loudspeakers of a sound system, and wherein the first amplifier module 711 is configured to drive the loudspeakers of the basic system 721 based on the basic system audio channels.

The second amplifier module 712 is arranged to receive the focus system audio channels provided by the focused source renderer 120 of the apparatus 100 for driving loudspeakers of a sound system, and wherein the second amplifier module 712 is configured to drive the loudspeakers of the focus system 722 based on the focus system audio channels.

In the following, the components of some embodiments are described. At first, a decoder 610 according to some embodiments is considered.

The audio is sent from a playback device, e.g. a gaming console or video player, and contains discrete audio channels for the basic system, being, for example, a surround system (surround setup), as well as additional audio channels enriched with meta-data describing how the focused sources should be reproduced. The meta-data includes parameters like the position relative to the head, the volume of the source and the panning factor for blending the auditory event between the sound bar and the basic system, e.g. a conventional surround setup. While the discrete audio channels are direct signals to be used with the surround system loudspeakers (surround setup loudspeakers), the additional audio channels first need to be transformed into loudspeaker signals for the sound bar's speakers.

The channels and meta-data can be encoded in several ways. Here are some examples of how the encoding could be done:

1. The synchronous transmission of the discrete channels and the additional effect channels and meta-data may be done via an encoded bit stream that can be packed into PCM channels of a regular multi-channel audio path (e.g. the 8-channel audio path of HDMI). This ensures compatibility with devices (e.g. game consoles) that already have such a connector available. A decoder 610 decodes the bit stream and provides the audio channels and meta-data to audio renderers. The meta-data could be stored into the lower bits of the additional sound channels. If no sound bar for using as described in the invention is available, the additional channels and meta-data can be used to down-mix the channels to the conventional surround setup. This makes the content backwards-compatible with existing surround setups at home.
2. The basic system audio channels (e.g.: surround channels/surround sound channels) and the additional effect channels may be transmitted in a way that the first audio channels contain the surround sound channels mixed with the additional focus audio base signals. The mix may be done in a way so that the direction of each additional effect channel is maintained when the mix is directly played back through a conventional surround setup. By this, backward compatibility is ensured, if these channels are played back in an environment where just a surround setup is available, but in opposite to No. 1, the sender of the format doesn't need to know whether there exist a receiver with a decoder 610 and a renderer. Additional information is provided to the decoder 610 containing information on how to extract the additional effect channels from the first surround channels. Finally, the meta-data for rendering the focused sources is provided. The additional information could be encoded into additional audio channels in parallel to the surround channels mentioned above. That way, a synchronous transmission of audio and meta-data is easily possible and regular media interfaces like HDMI can be used making embodiments compatible with a variety of already existing home entertainment systems. Most of today's surround content is 5.1, so there will be 2 extra channels available in the 8 channel HDMI stream to embed additional information for the focus effects.
3. As a special case of No. 2, an object based coding technology like Spatial Audio Object Coding (SAOC) (more information on SAOC can e.g. be found in [7]) could be used to transmit a surround down-mix of a multitude of audio objects which can be reconstructed on the decoder side using additional side information which is transmitted in parallel to the down-mix audio channels. After decoding, the resulting object based scene is rendered through both the surround audio system and the sound bar. Focused sources are either marked in the object's meta-data or can be selected automatically evaluating the position of the sources, so that sources in the proximity of the listener are rendered through the sound bar. By playing back an object in parts on both the surround setup and the sound bar, a transition of the source between the two audio systems is possible.

If the audio renderer is integrated into the generating device (e.g. a gaming console or other playback device), an encoding and decoding might not be necessary because the auditory events and surround audio channels can be accessed directly in memory and do not need to be transmitted from the playback device to the renderers.

In the following, a focused source renderer 120 according to some embodiments is described.

The focused source renderer 120 uses an algorithm to calculate filter coefficients for generating a plurality of loudspeaker signals which provide a sound field reproducing focused energy at a configurable point in the room. The filter defined by the coefficients is applied to the audio signal of an auditory event to create an output signal for one loudspeaker of the sound bar. A separate filter for each loudspeaker may be generated and applied to the focus audio base signal of the auditory event. The superposition of the loudspeaker signals will create a sound field in the room so that the audio energy in that sound field will be higher at the point where the auditory event should be localized compared to the sound energy in the surrounding area of that spot. If the source is positioned closely to the listener, the listener will get the impression as if the sound source really is positioned at that point. This leads to the illusion of the sound source being in the very proximity of the listener.

Another approach for creating the illusion of proximity is to provide a high level difference between the audio perceived between the two ears of the listener. This loudness difference creates the illusion of the audio source being directly beneath the ear receiving the main signal energy. When the position and orientation of the head is known, e.g. by using suitable tracking techniques, the position of the left and right ear can be estimated. The algorithm might control the signal processing in a way to achieve a level difference between these two points in space to the highest degree possible.

In an embodiment, a WFS (Wave Field Synthesis) based algorithm for creating focused sources is used to calculate the filter coefficients. The inputs of the algorithm may, e.g., be:

- the audio signal to be positioned within the room (focus audio base signal),
- the number of loudspeakers of the focus system,
- the positions of these loudspeakers in the room,
- the position of the focused source in relation to the listener (the focus point) and
- the position of the listener relative to the sound bar.

In this way, the audio is provided in an object based way: the focus audio base signal is intended to be played back at a given position relative to the listener's head. The position of the listener's head can either be configured or measured using a suitable tracking technology. Using a tracking device will provide more flexibility to the user because the system is able to adjust the position of the focus point so that it is constant relative to the listener's head when the listener is moving.

By combining the output signals of multiple audio renderers as described in FIG. 3*c*, the focused signals of several auditory events are reproduced using the same focus system. This allows for using more than one focused auditory event to be placed nearby the listener at a time. The game or film might render as much events as processing power and bandwidth of the transmission channel to the renderers allows.

Because of the nature of focused sound effects, a high number of loudspeakers may be needed to create a strongly audible focus effect that is experienced very clearly by the listener. To integrate a sound bar for the playback of focused sources into a home scenario, the space needed for the sound bar needs to be as small as possible to increase acceptance by possible customers of such an audio solution. Therefore, the loudspeaker drivers need to be as small as possible to optimize the space needed. Since a small loudspeaker driver usually is not able to reproduce low frequency components with sufficient sound pressure level, the sound bar may need additional support from the basic system, e.g. a surround system/surround setup, for lower frequencies.

An embodiment splits the signal of a focused auditory event into a high frequency and a low frequency component. The cross-over frequency between these components may differ depending on the size and quality of the used loudspeaker drivers in the sound bar. The low-frequency components are played through the surround system while the high frequency components are played as a focus effect through the focus system. There might be a cross-over frequency range where both systems are playing in order to achieve a smooth transition between the systems.

Depending on the distance of the source to the listener, the focus audio base signal can be blended between the focus system and the surround system by using (one or more) panning factors. The factors can be calculated by a panning law based on which the panning is applied to the two audio systems. Therefore, the distance perception at the listening position can be controlled by blending the signal between the focus system and the surround system. The listener will perceive the source to be closer when the blending is controlled so that more signal energy is played through the focus system and the corresponding focus point is close to the listener.

In one embodiment the (one or more) panning factors for blending between the focus system and the surround system are calculated from positional meta-data, e.g. from the distance between the source and the listener. In this way, the position of the audio object (the focus point) is used to decide which of the two audio systems is involved and to what extend for providing the according loudspeaker signals.

Alternatively, the blending can be made controllable in such a way that the content playback system, for example the gaming console, is sending the intended panning factors as meta-data along with the focus audio base signal. In this case, the (one or more) panning factors implicitly describe the distance of the audio effect. The focus point for the focus rendering might even be a static position and the movement is realized by blending the audio base signal between the statically positioned focus point and the corresponding surround system rendering. Another approach might use both the movement of the focus point and the panning factors to give the listener the impression of the audio source changing its distance.

The surround system may, e.g., be in most cases involved in playing back a focus audio object. In contrast to regular surround audio distribution where the loudspeaker signals are provided directly, the focus base audio signal needs to be rendered to the surround system first to generate the surround system loudspeaker signals. A conventional surround panning technique can be used to provide surround channels that pan the sound of the audio object to the corresponding direction. The distance of the object will then be determined by using the mentioned panning factors between the focus system and the surround system.

If the frequency range between the focus system and the surround system is split so that low frequencies up to a certain frequency are played back exclusively by the surround system, the blending for changing the distance of an object may, e.g., not include these low frequencies since the small loudspeaker drivers of the focus system usually may not be able to reproduce those low frequencies.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive decomposed signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[1] ACOUSTIC CONTROL BY WAVE FIELD SYNTHESIS, Berkhout, A. J., de Vries, D., and Vogel, P. (1993), Journal Acoustic Society of America, 93(5):2764-2778.

[2] WAVE FIELD SYNTHESIS DEVICE AND METHOD FOR DRIVING AN ARRAY OF LOUDSPEAKERS, Roder, T., Sporer, T., and Brix, S. (2007).

[3] FOCUSING OF VIRTUAL SOUND SOURCES IN HIGHER ORDER AMBISONICS, Ahrens, Jens, Spors, Sascha, 124th AES Convention, Amsterdam, The Netherlands, May 2008.

[4] METHOD AND SYSTEM FOR PROVIDING DIGITALLY FOCUSED SOUND, patent application WO02071796 A1

[5] SOUND FOCUSING IN ROOMS: THE TIME-REVERSAL APPROACH, Sylvain Yon, Mickael Tanter, and Mathias Fink, J. Acoust. Soc. Am., 2002.

[6] DEVICE AND METHOD FOR CONTROLLING A PUBLIC ADDRESS SYSTEM, AND A CORRESPONDING PUBLIC ADDRESS SYSTEM, patent EP1800517

[7] SPATIAL AUDIO OBJECT CODING (SAOC)—THE UPCOMING MPEG STANDARD ON PARAMETRIC OBJECT BASED AUDIO CODING, Breebaart, Jeroen; Engdegård, Jonas; Falch, Cornelia; Hellmuth, Oliver; Hilpert, Johannes; Hoelzer, Andreas; Koppens, Jeroen; Oomen, Werner; Resch, Barbara; Schuijers, Erik; Terentiev, Leonid; in 124th AES Convention, Amsterdam, Netherlands, May 2008.

The invention claimed is:

1. An apparatus for driving loudspeakers of a sound system, the sound system comprising at least four loudspeakers of a surround system, and at least three loudspeakers of a focus system, wherein each of the loudspeakers of the surround system and of the focus system has a position in an environment, and wherein the apparatus comprises:

a surround channel provider for providing surround system audio channels to drive the loudspeakers of the surround system, a focused source renderer for providing focus system audio channels to drive the loudspeakers of the focus system, wherein the focused source renderer is configured to calculate a plurality of delay values for the loudspeakers of the focus system based on the positions of the loudspeakers of the focus system and based on a position of a focus point, wherein the focused source renderer is configured to generate at least three focus group audio channels for at least some of the loudspeakers of the focus system based on the plurality of delay values and based on a focus audio base signal to provide the focus system audio channels, so that an audio output produced by the loudspeakers of the focus system, when being driven by the focus system audio channels, allows localizing the position of the focus point by a listener in the environment, wherein the focus audio base signal only comprises first frequency portions of an audio effect signal, wherein the first frequency portions only have frequencies which are higher than a first predetermined frequency value, and wherein at least some of the first frequency portions have frequencies which are higher than a second predetermined frequency value, wherein the second predetermined frequency value is higher than or equal to the first predetermined frequency value, wherein the focused source renderer is configured to generate the at least three focus group audio channels based on the focus audio base signal such that the focus group audio channels only have frequencies which are higher than a predetermined frequency value, and wherein the surround channel provider is configured to generate the surround system audio channels based on a secondary effect signal, wherein the secondary effect signal only comprises second frequency portions of the audio effect signal, wherein the second frequency portions only have frequencies which are lower than or equal to the second predetermined frequency value, and wherein at least some of the second frequency portions have frequencies which are lower than or equal to the first predetermined frequency value.

2. An apparatus according to claim 1, wherein the focused source renderer is adapted to generate the at least three focus group audio channels, so that the audio output produced by the focus system allows localizing the position of the focus point by the listener in the environment, wherein the position of the focus point is closer to a position of a sweet spot in the environment than any other position of one of the loudspeakers of the surround system and closer to the position of the sweet spot than any other position of one of the loudspeakers of the focus system.

3. An apparatus according to claim 1, wherein the second predetermined frequency value is equal to the first predetermined frequency value.

4. An apparatus according to claim 1, wherein the focused source renderer is adapted to adjust channel levels of the focus system audio channels to drive the loudspeakers of the focus system.

5. An apparatus according to claim 1, wherein the focus system comprises one or more sound bars, each of the sound bars comprising at least 3 loudspeakers in a single enclosure.

6. An apparatus according to claim 1, wherein the focus system is a Wave Field Synthesis system.

7. An apparatus according to claim 1, wherein the focus system employs Higher Order Ambisonics.

8. An apparatus according to claim 1, wherein the surround system is a 5.1 surround system.

9. An apparatus according claim 1, wherein the plurality of the delay values is a plurality of time delay values, and wherein the focused source renderer is adapted to generate each of the focus audio channels by time shifting the focus audio base signal by one of the time delays of the plurality of time delays.

10. An apparatus according to claim 1, wherein the plurality of the delay values is a plurality of phase values, and wherein the focused source renderer is adapted to generate each of the focus audio channels by adding one of the phase values of the plurality of phase values to each phase value of a frequency-domain representation of the focus audio base signal.

11. An apparatus according to claim 1, wherein the focused source renderer is configured to generate the at least three focus group audio channels for at least some of the loudspeakers of the focus system based on the plurality of delay values and based on the focus audio base signal to provide the focus system audio channels, so that sound waves emitted by the loudspeakers of the focus system, when being driven by the focus system audio channels, form a constructive superposition which creates a local maximum of a sum of energies of the sound waves in the focus point.

12. An apparatus for driving loudspeakers of a sound system, the sound system comprising at least four loudspeakers of a surround system, and at least three loudspeakers of a focus system, wherein each of the loudspeakers of the surround system and of the focus system has a position in an environment, and wherein the apparatus comprises:

a surround channel provider for providing surround system audio channels to drive the loudspeakers of the surround system, a focused source renderer for providing focus system audio channels to drive the loudspeakers of the focus system, wherein the focused source renderer is configured to calculate a plurality of delay values for the loudspeakers of the focus system based on the positions of the loudspeakers of the focus system and based on a position of a focus point, wherein the focused source renderer is configured to generate at least three focus group audio channels for at least some of the loudspeakers of the focus system based on the plurality of delay values and based on a focus audio base signal to provide the focus system audio channels, so that an audio output produced by the loudspeakers of the focus system, when being driven by the focus system audio channels, allows localizing the position of the focus point by a listener in the environment, wherein the surround channel provider is configured to generate the surround system audio channels based on the focus audio base signal and based on a panning factor for blending the focus audio base signal between the surround system and the focus system, and wherein the focused source renderer is configured to generate the at least three focus group audio channels based on the focus audio base signal and based on the panning factor for blending the focus audio base signal between the surround system and the focus system.

13. An apparatus for driving loudspeakers of a sound system, the sound system comprising at least four loudspeakers of a surround system, and at least three loudspeakers of a focus system, wherein each of the loudspeakers of the surround system and of the focus system has a position in an environment, and wherein the apparatus comprises:

a surround channel provider for providing surround system audio channels to drive the loudspeakers of the surround system, a focused source renderer for providing focus system audio channels to drive the loudspeakers of the focus system, wherein the focused source renderer is configured to calculate a plurality of delay values for the loudspeakers of the focus system based on the positions of the loudspeakers of the focus system and based on a position of a focus point, wherein the focused source renderer is configured to generate at least three focus group audio channels for at least some of the loudspeakers of the focus system based on the plurality of delay values and based on a focus audio base signal to provide the focus system audio channels, so that an audio output produced by the loudspeakers of the focus system, when being driven by the focus system audio channels, allows localizing the position of the focus point by a listener in the environment, wherein the apparatus furthermore comprises a decoder being configured to decode an audio data stream to obtain a first group of one or more audio input channels, a second group of one or more audio input channels and meta-data comprising information on the position of the focus point, wherein the information on the position of the focus point is relative to a position of a listener, wherein the decoder is arranged to feed the first group of audio input channels into the surround channel provider, and wherein the surround channel provider is configured to provide the surround system audio channels to the loudspeakers based on the first group of audio input channels, and wherein the decoder is arranged to feed the second group of audio input channels and the information on the position of the focus point into the focused source renderer, and wherein the focused source renderer is configured to generate the at least three focus audio channels based on the focus audio base signal, wherein the focus audio base signal depends on one or more audio input channels of the second group of audio input channels.

14. An apparatus for driving loudspeakers of a sound system, the sound system comprising at least four loudspeakers of a surround system, and at least three loudspeakers of a focus system, wherein each of the loudspeakers of the surround system and of the focus system has a position in an environment, and wherein the apparatus comprises:

a surround channel provider for providing surround system audio channels to drive the loudspeakers of the surround system, a focused source renderer for providing focus system audio channels to drive the loudspeakers of the focus system, wherein the focused source renderer is configured to calculate a plurality of delay values for the loudspeakers of the focus system based on the positions of the loudspeakers of the focus system and based on a position of a focus point, wherein the focused source renderer is configured to generate at least three focus group audio channels for at least some of the loudspeakers of the focus system based on the plurality of delay values and based on a focus audio base signal to provide the focus system audio channels, so that an audio output produced by the loudspeakers of the focus system, when being driven by the focus system audio channels, allows localizing the position of the focus point by a listener in the environment, wherein the apparatus furthermore comprises a decoder being configured to decode an audio data stream to obtain a first group of one or more audio input channels, a second group of one or more audio input channels and meta-data comprising information on the position of the focus point, wherein the information on the position of the focus point is relative to a position of a listener, wherein each of the audio input channels of the first group of audio input channels comprises surround channel information and first focus information, wherein each of the audio input channels of the second group of audio input channels comprises second focus information, wherein the decoder is configured to generate a third group of one or more modified audio channels based on the surround channel information of the first group of the audio input channels, wherein the decoder is arranged to feed the third group of modified audio channels into the surround channel provider, and wherein the surround channel provider is configured to provide the surround system audio channels to the loudspeakers based on the third group of modified audio channels, and wherein the decoder is configured to generate a fourth group of modified audio channels based on the first focus information of the first group of audio input channels and based on the second focus information of the second group of audio input channels, wherein the decoder is arranged to feed the fourth group of modified audio channels and the information on the position of the focus point into the focused source renderer, and wherein the focused source renderer is configured to generate the at least three focus audio channels based on the focus audio base signal, wherein the focus audio base signal depends on one or more modified audio channels of the fourth group of modified audio channels.

15. An apparatus according to claim 14, wherein the decoder is configured to decode the audio data stream to obtain six channels of an HDMI audio signal as the first group of audio input channels, and wherein the decoder is configured to decode the audio data stream to obtain two further channels of the HDMI audio signal as the second group of audio input channels.

16. An apparatus according to claim 15, wherein the decoder is configured to decode the audio data stream to obtain six channels of a 5.1 surround signal as the first group of audio input channels, wherein the decoder is arranged to feed the six channels of the 5.1 surround signal into the surround channel provider, and wherein the surround channel provider is configured to provide the six channels of the 5.1 surround signal to drive the loudspeakers of the surround system.

17. An apparatus according to claim 16, wherein the decoder is configured to decode the audio data stream to obtain a plurality of spatial audio object channels of a plurality of encoded spatial audio objects, wherein the decoder is configured to decode at least one object position information for at least one of the spatial audio object channels, wherein the decoder is arranged to feed the plurality of the spatial audio object channels and the at least one object position information into the focused source renderer, wherein the focused source renderer is configured to calculate the plurality of delay values for the loudspeakers of the focus system based on the positions of the loudspeakers of the focus system and based on one of the at least one object position information representing information on the position of the focus point, and wherein the focused source renderer is configured to generate the at least three focus audio channels for at least some of the loudspeakers of the focus system based on the focus audio base signal, wherein the focus audio base signal depends on one or more of the plurality of the spatial audio object channels.

18. An apparatus for driving loudspeakers of a sound system, the sound system comprising at least four loudspeakers of a surround system, and at least three loudspeakers of a focus system, wherein each of the loudspeakers of the surround system and of the focus system has a position in an environment, and wherein the apparatus comprises:

a surround channel provider for providing surround system audio channels to drive the loudspeakers of the surround system, a focused source renderer for providing focus system audio channels to drive the loudspeakers of the focus system, wherein the focused source renderer is configured to calculate a plurality of delay values for the loudspeakers of the focus system based on the positions of the loudspeakers of the focus system and based on a position of a focus point, wherein the focused source renderer is configured to generate at least three focus group audio channels for at least some of the loudspeakers of the focus system based on the plurality of delay values and based on a focus audio base signal to provide the focus system audio channels, so that an audio output produced by the loudspeakers of the focus system, when being driven by the focus system audio channels, allows localizing the position of the focus point by a listener in the environment, wherein the focused source renderer is configured to calculate the plurality of delay values as a first group of delay values, wherein the position of the focus point is a first position of a first focus point, and wherein the focus audio base signal is a first focus audio base signal, wherein the focused source renderer is furthermore configured to generate the at least three focus audio channels as a first group of focus audio channels, wherein the focused source renderer is furthermore configured to calculate a second group of delay values for the loudspeakers of the focus system based on the positions of the loudspeakers of the focus system and based on a second position of a second focus point, wherein the focused source renderer is furthermore configured to generate a second group of at least three focus audio channels for at least some of the loudspeakers of the focus system based on the plurality of delay values of the second group of delay values and based on a second focus audio base signal, wherein the focused source renderer is furthermore configured to generate a third group of at least three focus audio channels for at least some of the loudspeakers of the focus system, wherein each of the focus audio channels of the third group of focus audio channels is a combination of one of the focus audio channels of the first group of focus audio channels and one of the focus audio channels of the second group of focus audio channels, and wherein the focused source renderer is adapted to provide the focus audio channels of the third group of focus audio channels as the focus system audio channels to drive the loudspeakers of the focus system.

19. A sound system, comprising:

a surround system comprising at least four loudspeakers, a focus system comprising at least three further loudspeakers, a first amplifier module, a second amplifier module, and an apparatus for driving loudspeakers of a sound system, the sound system comprising at least four loudspeakers of a surround system, and at least three loudspeakers of a focus system, wherein each of the loudspeakers of the surround system and of the focus system has a position in an environment, and wherein the apparatus comprises:

a surround channel provider for providing surround system audio channels to drive the loudspeakers of the surround system, a focused source renderer for providing focus system audio channels to drive the loudspeakers of the focus system, wherein the focused source renderer is configured to calculate a plurality of delay values for the loudspeakers of the focus system based on the positions of the loudspeakers of the focus system and based on a position of a focus point, wherein the focused source renderer is configured to generate at least three focus group audio channels for at least some of the loudspeakers of the focus system based on the plurality of delay values and based on a focus audio base signal to provide the focus system audio channels, so that an audio output produced by the loudspeakers of the focus system, when being driven by the focus system audio channels, allows localizing the position of the focus point by a listener in the environment, wherein the first amplifier module is arranged to receive the surround system audio channels provided by the surround channel provider of the apparatus according to claim 1, and wherein the first amplifier module is configured to drive the loudspeakers of the surround system based on the surround system audio channels, and wherein the second amplifier module is arranged to receive the focus system audio channels provided by the focused source renderer of the apparatus according to claim 1, and wherein the second amplifier module is configured to drive the loudspeakers of the focus system based on the focus system audio channels.

20. A method for driving loudspeakers of a sound system, the sound system comprising at least four loudspeakers of a surround system, and at least three loudspeakers of a focus system, wherein each of the loudspeakers of the surround system and of the focus system has a position in an environment, and wherein the method comprises:

providing surround system audio channels to drive the loudspeakers of the surround system, providing focus system audio channels to drive the loudspeakers of the focus system, calculating a plurality of delay values for the loudspeakers of the focus system based on the positions of the loudspeakers of the focus system and based on a position of a focus point, and generating at least three focus group audio channels for at least some of the loudspeakers of the focus system based on the plurality of delay values and based on a focus audio base signal to provide the focus system audio channels, so that an audio output produced by the loudspeakers of the focus system, when being driven by the focus system audio channels, allows localizing the position of the focus point by a listener in the environment wherein the focus audio base signal only comprises first frequency portions of an audio effect signal, wherein the first frequency portions only have frequencies which are higher than a first predetermined frequency value, and wherein at least some of the first frequency portions have frequencies which are higher than a second predetermined frequency value, wherein the second predetermined frequency value is higher than or equal to the first predetermined frequency value, wherein the at least three focus group audio channels are generated based on the focus audio base signal such that the focus group audio channels only have frequencies which are higher than a predetermined frequency value, and wherein the surround system audio channels are generated based on a secondary effect signal, wherein the secondary effect signal only comprises second frequency portions of the audio effect signal, wherein the second frequency portions only have frequencies which are lower than or equal to the second predetermined frequency value, and wherein at least some of the second frequency portions have frequencies which are lower than or equal to the first predetermined frequency value.

21. A non-transitory computer readable medium with a computer program for implementing a method according to claim 20, when the computer program is executed by a computer or signal processor.

* * * * *